US006255778B1

(12) United States Patent
Yoshikawa et al.

(10) Patent No.: US 6,255,778 B1
(45) Date of Patent: Jul. 3, 2001

(54) PLASMA DISPLAY PANEL HAVING ELECTROMAGNETIC WAVE SHIELDING MATERIAL ATTACHED TO FRONT SURFACE OF DISPLAY

(75) Inventors: Masato Yoshikawa; Yasuhiro Morimura, both of Tokyo (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/166,540

(22) Filed: Oct. 5, 1998

(30) Foreign Application Priority Data

| | | |
|---|---|---|
| Oct. 13, 1997 | (JP) | 9-278770 |
| Oct. 13, 1997 | (JP) | 9-278771 |
| Oct. 13, 1997 | (JP) | 9-278772 |
| Oct. 13, 1997 | (JP) | 9-278773 |
| Oct. 13, 1997 | (JP) | 9-278774 |
| Oct. 13, 1997 | (JP) | 9-278775 |
| Oct. 13, 1997 | (JP) | 9-278776 |
| Oct. 13, 1997 | (JP) | 9-278777 |
| Oct. 13, 1997 | (JP) | 9-278778 |

(51) Int. Cl.[7] ..... H01J 17/49
(52) U.S. Cl. ..... 313/582; 313/479; 313/473
(58) Field of Search ..... 313/582, 583, 313/584, 585, 586, 587, 473, 479, 478, 313; 428/441

(56) References Cited

U.S. PATENT DOCUMENTS

| | | | | |
|---|---|---|---|---|
| 4,412,255 | | 10/1983 | Kuhlman et al. . | |
| 5,084,649 | * | 1/1992 | Sasao | 313/474 |
| 5,244,708 | * | 9/1993 | Tsuchida et al. | 428/77 |
| 5,246,771 | * | 9/1993 | Kawaguchi | 428/261 |
| 5,605,595 | * | 2/1997 | Beeteson et al. | 156/295 |
| 5,811,923 | * | 9/1998 | Zieba et al. | 313/479 |
| 6,030,708 | * | 2/2000 | Ishibashi et al. | 428/441 |

FOREIGN PATENT DOCUMENTS 0 834 898 4/1998 (EP) .

OTHER PUBLICATIONS

Patent Abstracts of Japan, vol. 098, No. 001, Jan. 30, 1998 & JP 09 247583 A (Fujitsu General Ltd), Sep. 19, 1997.
Patent Abstracts of Japan, vol. 014, No. 357(M–1005), Aug. 2, 1990 & JP 02 127035 A (Tomoegawa Paper Co., Ltd), May 15, 1990.
Patent Abstracts of Japan, vol. 095, No. 010, Nov. 30, 1995 & JP 07 176887 A (Tokimec Inc; others: 01), Jul. 14, 1995.
Patent Abstracts of Japan, vol. 018, No. 010 (E–1487), Jan. 10, 1994 & JP 05 251890 A (Michio Arai), Sep. 28, 1993.

* cited by examiner

*Primary Examiner*—Nimeshkumar D. Patel
*Assistant Examiner*—Karabi Guharay
(74) *Attorney, Agent, or Firm*—Kanesaka & Takeuchi

(57) ABSTRACT

An electromagnetic-wave shielding material, such as a conductive mesh member 3, is bonded to a front surface of a PDP body 20 by transparent adhesives 4B, 4C and a transparent base plate 2 is bonded to a surface of the electromagnetic-wave shielding material by transparent adhesives 4A so that they are integrated together. In this way, electromagnetic-wave shielding efficiency is imparted to a display panel itself, thereby lightening its weight, making its wall thinner, reducing the number of parts, and thus improving the productivity and reducing the cost.

26 Claims, 9 Drawing Sheets

PLASMA DISPLAY PANEL HAVING ELECTROMAGNETIC WAVE SHIELDING MATERIAL ATTACHED TO FRONT SURFACE OF DISPLAY

FIELD OF THE INVENTION

The present invention relates to a gas discharge type display panel utilizing a plasma display panel (hereinafter, referred to as "PDP") and, more particularly, to a display panel utilizing a PDP which is integrated with electromagnetic-wave shielding material to impart electromagnetic-wave shielding efficiency to the display panel itself, thereby lightening its weight, making its wall thinner, reducing the number of parts, and thus improving the productivity and reducing the cost.

DESCRIPTION OF THE RELATED PART

A PDP (plasma display panel) utilizing a discharging phenomenon has the following advantages in comparison to a liquid crystal display (LCD) and a cathode ray tube (CRT). Therefore, recently it has been researched and developed for practical use, for example, televisions, office automatic apparatus such as personal computers and word processors, traffic apparatus, boards, and other kinds of display panels.

1. It utilizes discharge light so that it is spontaneous light.
2. As its discharge gap is 0.1–0.3 mm, it can be shaped in panel.
3. By using fluorescent substances, it can emit colors.
4. It eases to make wide screen.

The basic display mechanism of the PDP is displaying of letters and figures by selective discharge emitting of fluorescent substances in many discharge cells which are disposed distantly each other between two plate glasses, and for example, has a mechanism as shown in FIG. 9.

In FIG. 9, a numeral 121 designates a front glass, 122 designates a rear glass, 123 designates a bulkhead, 124 designates a display cell (discharge cell), 125 designates an auxiliary cell, 126 designates a cathode, 127 designates a display anode, 128 designates an auxiliary anode. A red fluorescent substance, a green fluorescent substance, or a blue fluorescent substance (not shown) is provided in a film form on internal walls of each display cell 124 and these fluorescent substances emit light by electrical discharges when a voltage is applied between electrodes.

From the front surface of the PDP, electromagnetic waves with frequency from several kHz to several GHz are generated due to applying voltage, electrical discharge, and light emission, and the electromagnetic waves have to be shielded. Moreover, for improving its display contrast, reflection of external light at the front surface has to be prevented.

In order to shield such electromagnetic waves from PDP, a transparent plate which has electromagnetic-wave shielding efficiency is disposed in front of the PDP.

The PDP in which the separate transparent plate is disposed in front of the PDP has defects as follows:

1. Structure for disposing two panels is complicated.
2. As a transparent base plate made of glass or the like is required for each of the PDP and the electromagnetic-wave shielding transparent plate, the PDP and the electromagnetic-wave shielding transparent plate make thicker and heavier in total.
3. The number of parts and man-hours are increased, thereby raising the cost.

OBJECT AND SUMMARY OF THE INVENTION

It is an object of the present invention to solve the conventional problems as mentioned above and to provide a display panel utilizing a PDP which is integrated with electromagnetic-wave shielding material to impart electromagnetic-wave shielding efficiency to the display panel itself, thereby lightening its weight, making its wall thinner, reducing the number of parts, and thus improving the productivity and reducing the cost.

It is also an object of the present invention to provide a display panel which has good light transparency and high electromagnetic-wave shielding efficiency and thus can provide distinct pictures by preventing moiré phenomenon when a conductive mesh is used as electromagnetic-wave shield.

It is another object of the present invention to provide a display panel which has high safety by preventing scattering of fragments when damaged.

It is yet another object of the present invention to provide a display panel which has good light transparency and high electromagnetic-wave shielding efficiency and thus can provide distinct pictures without problems of moiré phenomenon.

It is further another object of the present invention to provide a display panel which has both electromagnetic-wave shielding efficiency and heat ray blocking efficiency.

It is still further another object of the present invention to provide a display panel which can easily provide conduction between an electromagnetic-wave shielding material and a body of equipment and can be easily built in the body of equipment.

A display panel of the first aspect comprises a plasma display panel body and an electromagnetic-wave shielding material which is bonded to a front surface of the plasma display panel body by transparent adhesives.

The display panel of the first aspect can be manufactured lighter, thinner, and with reduced number of parts because the PDP and the electromagnetic-wave shielding material are integrated by the transparent adhesives and thus can improve of the productivity and the reduction of the cost.

In the first aspect, it is preferable that the electromagnetic-wave shielding material is a conductive mesh member. In addition, it is preferable that a transparent base plate is bonded to a front surface of the electromagnetic-wave shielding material by transparent adhesives.

The first aspect also provides a display panel comprising a plasma display panel body, an electromagnetic-wave shielding material which is bonded to a front surface of the plasma display panel body by transparent adhesives, and a transparent base plate which is bonded to a front surface of the electromagnetic-wave shielding material by transparent adhesives, wherein the electromagnetic-wave shielding material is a conductive mesh member and wherein the transparent adhesives are transparent elastic adhesives. In the display panel, because the PDP body, the conductive mesh member and the transparent base plate are integrated by transparent elastic adhesives, the scattering of fragments when the display panel is broken due to some impact can be prevented, thereby improving its safety.

In the first aspect, the conductive mesh may be a composite mesh member in which metallic fibers and/or metal-coated organic fibers and organic fibers are woven. Since the composite mesh member can be woven without fraying even when it is made of fine fibers to have a large open area ratio, by using, as the electromagnetic-wave shielding material, the conductive composite mesh member in which metallic fibers and/or metal-coated organic fibers and organic fibers are woven, the degree of freedom for line width and the open area ratio is improved. Therefore, it can easily provide a conductive mesh member having excellent electromagnetic-wave shielding efficiency and light transparency without moire phenomenon.

Further in the first aspect, a heat-ray blocking layer may be interposed between the transparent base plate and the plasma display panel body. By integrating the heat-ray blocking layer as well as the electromagnetic shielding material, the display panel can provide not only the electromagnetic-wave shielding efficiency but also heat-ray (near infrared ray) blocking efficiency.

A display panel of the second aspect comprises a plasma display panel body, an electromagnetic-wave shielding material which is bonded to a front surface of the plasma display panel body by transparent adhesives, and a transparent base plate which is bonded to a front surface of the electromagnetic-wave shielding material by transparent adhesives, wherein the electromagnetic-wave shielding material is a conductive foil which is formed by pattern etching.

The display panel of the second aspect can be manufactured lighter, thinner, and with reduced number of parts because the PDP and the electromagnetic-wave shielding material are integrated by the transparent adhesives and thus can improve the productivity and the reduction of the cost.

Since the conductive foil can be formed in any desirable pattern by pattern etching, the degree of freedom for line width and the open area ratio is significantly higher than the conductive mesh member.

Therefore, it can easily actualize excellent electromagnetic-wave shielding efficiency by using a pattern-etched conductive foil having good electromagnetic-wave shielding efficiency and light transparency without moiré phenomenon.

A display panel of the third aspect comprises a plasma display panel body, and a transparent base plate which is bonded to a front surface of the plasma display panel body by transparent adhesives, wherein the transparent base plate is provided with a conductive layer on a bonding surface thereof which is composed of a conductive film formed by pattern etching.

The display panel of the third aspect can be manufactured lighter, thinner, and with reduced number of parts because the PDP, the electromagnetic-wave shielding material, and the transparent base plate provided with the conductive layer are integrated by the transparent adhesives and thus can improve the productivity and the reduction of the cost.

Since the conductive layer can be formed in any desirable pattern by pattern etching, the degree of freedom for line width and the open area ratio is significantly higher than the conductive mesh member.

Therefore, it can easily actualize excellent electromagnetic-wave shielding efficiency by using a pattern-etched conductive layer having good electromagnetic-wave shielding efficiency and light transparency without moiré phenomenon.

A display panel of the fourth aspect comprises a plasma display panel body, and a transparent base plate which is bonded to a front surface of the plasma display panel body by transparent adhesives, wherein the transparent base plate is provided with a conductive layer on a bonding surface thereof which is made of conductive ink by pattern printing.

The display panel of the fourth aspect can be manufactured lighter, thinner, and with reduced number of parts because the PDP, the electromagnetic-wave shielding material, and the transparent base plate provided with the conductive layer are integrated by the transparent adhesives and thus can improve the productivity and the reduction of the cost.

Since the conductive layer can be formed in any desirable pattern by pattern printing, the degree of freedom for line width and the open area ratio is significantly higher than the conductive mesh member.

Therefore, it can easily actualize excellent electromagnetic-wave shielding efficiency by using a conductive layer formed by pattern printing having good electromagnetic-wave shielding efficiency and light transparency without moire phenomenon.

A display panel of the fifth aspect comprises a plasma display panel body, a conductive mesh member which is bonded to a front surface of the plasma display panel body by transparent adhesives, and a transparent base plate which is bonded to a front surface of the conductive mesh member by transparent adhesives, wherein a transparent conductive layer is also disposed between the plasma display panel body and the transparent base plate.

The display panel of the fifth aspect can be manufactured lighter, thinner, and with reduced number of parts because the PDP and the transparent base plate are integrated through the conductive mesh member and the transparent conductive layer by the transparent adhesives and thus can improve the productivity and the reduction of the cost.

The display panel of the fifth aspect can be provided with excellent electromagnetic-wave shielding efficiency by using the transparent conductive layer with the conductive mesh member. Since the electromagnetic-wave shielding efficiency is obtained by using the transparent conductive layer with the conductive mesh member as mentioned above, it is able to think much of moire phenomenon in design stage of the conductive mesh member and thus able to design mesh with less moiré phenomenon.

A display panel of the sixth aspect comprises a plasma display panel body, a transparent conductive film which is bonded to a front surface of the plasma display panel body by transparent adhesives, and a transparent base plate which is bonded to a front surface of the transparent conductive film by transparent adhesives, wherein conductive adhesive tapes A are bonded to cover portions from outer edges of the transparent conductive film to outer edges of the rear surface of the plasma display panel body through side ends of the plasma display panel body.

The display panel of the sixth aspect can be manufactured lighter, thinner, and with reduced number of parts because the PDP, the transparent conductive film, and the transparent base plate are integrated by the transparent adhesives and thus can improve the productivity and the reduction of the cost.

In the display panel of the sixth aspect, the conduction of the transparent conductive film can be easily drawn through the conductive adhesive tape adhering to portions from outer edges of the transparent conductive film and outer edges of the PDP body. Just by inlaying the display panel in the body of equipment, the conduction between the transparent conductive film and the body of equipment is provided through the conductive adhesive tape so that the display panel can be easily built in the body of equipment.

According to the sixth aspect, it is preferable that, in addition to the conductive adhesive tape A, a conductive adhesive tape B is bonded to all around ends of the transparent base plate and the plasma display panel body and also bonded to outer edges of the front surface of the transparent base plate and outer edges of the rear surface of the plasma display panel body. This improves the bonding strength of the display panel and thus its handling so that the assemblage to the body of equipment becomes further easier and uniform and stable conduction can be provided.

By the way, as a conventional conductive adhesive tape is impossible to tack temporary or re-adhere, there are problems of bad workability and insufficient durability and/or adhesive strength at joint parts. On the contrary, the utilization of the conductive adhesive tape of cross-linked type, in particular, having a post-cross-linkable adhesive layer containing ethylene-vinyl acetate copolymer and cross-linking agent for the ethylene-vinyl acetate copolymer enables effective assemblage because of the following characteristics:

(i) good adhesion properties, thereby allowing easy temporal adhesion to an adherend with suitable tack;

(ii) suitable tackiness before cross-linking, i.e. enough for the temporal adhesion but not so strong as to allow re-adhesion, thereby facilitate the amendment;

(iii) very strong tackiness after cross-linking, thereby exhibiting high bond strength;

(iv) high moisture proof and heat resistance, and exhibiting high durability; and (v) cross-linkable at a temperature lower than 130° C. in case of thermal cross-linking and cross-linkable even with light. The cross-linking can be conducted at a relatively low temperature, thereby facilitating the adhesion operation.

DESCRIPTION OF THE PREFERRED EMBODIMENTS

Hereinafter, embodiments of the present invention will be described in detail with reference to the drawings.

First of all, the first aspect of the present invention will be described with reference to FIG. 1.

Figure 1:
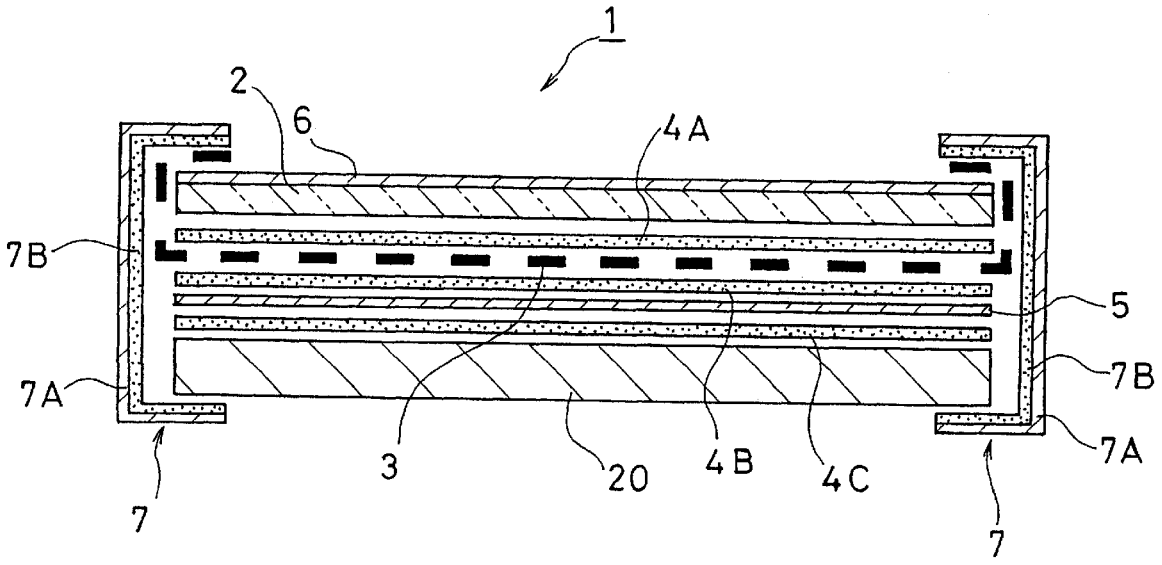
FIG. 1 is a schematic sectional view showing an embodiment of a display panel of the first aspect.

FIG. 1 is a schematic sectional view showing an embodiment of a display panel of the first aspect.

Figure 9:
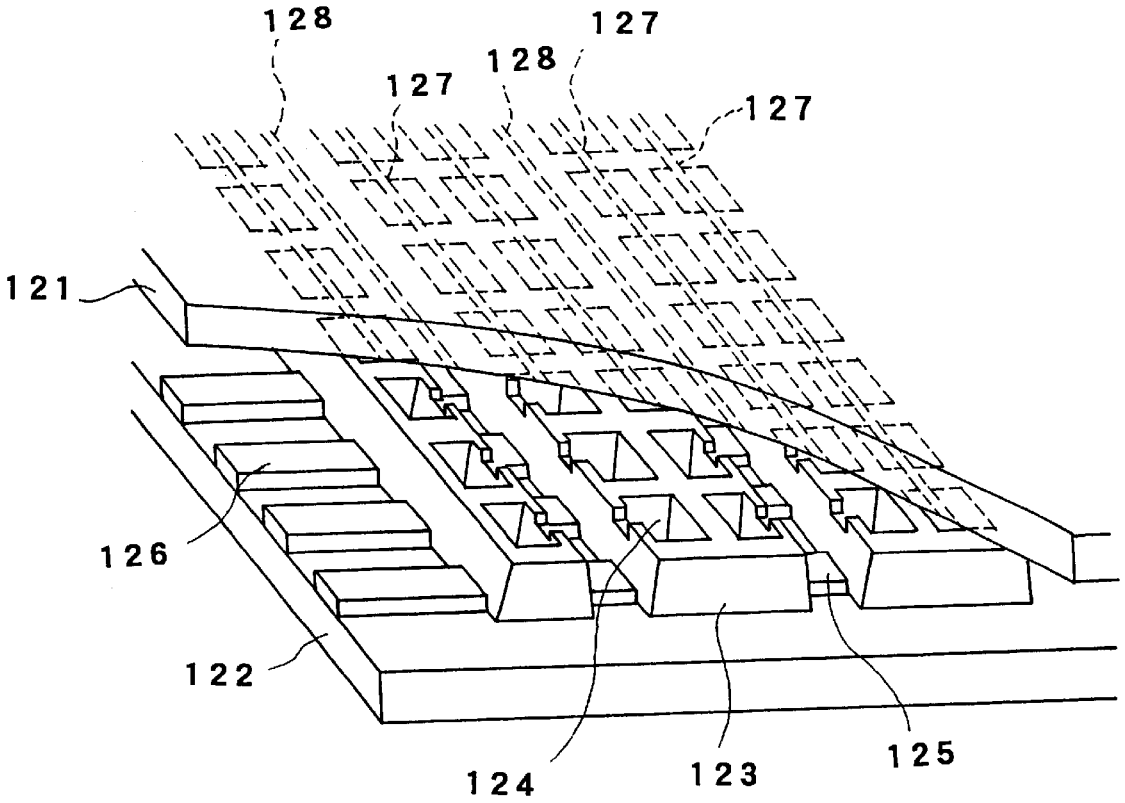
Fig. 9 PRIOR ART
FIG. 9 is a partially cutaway perspective view showing the structure of a typical PDP.

The display panel 1 comprises a transparent base plate 2, a PDP body 20 (any of typical PDPs such as the PDP having the structure as shown in FIG. 9), a conductive mesh member 3, and a heat-ray blocking film 5. The conductive mesh member 3 and the heat-ray blocking film 5 are interposed between the transparent base plate 2 and the PDP body 20 and are bonded together using intermediate adhesive layers 4A, 4B, 4C as adhesives so as to form an assembled unit. The periphery of the conductive mesh member 3 is positioned outside of peripheral edges of the transparent base plate 2 so as to form margins which are folded along the peripheral edges of transparent base plate 2 and bonded to the transparent base plate 2 by a conductive adhesive tape 7.

In this embodiment, the conductive adhesive tape 7 adheres to all around ends of the assembled unit of the transparent base plate 2, the conductive mesh member 3, the heat-ray blocking film 5, and the PDP body 20 and also adheres to outer edges of both surfaces of the assembled unit, i.e. outer edges of the front surface of the transparent base plate 2 and outer edges of the rear surface of the PDP body 20.

The conductive adhesive tape 7 is formed, for example, by laying a conductive adhesive layer 7B on one surface of a metallic foil 7A. The metallic foil 7A for the conductive adhesive tape 7 may have a thickness of 1 to 100 $\mu$m and may be made of metal such as copper, silver, nickel, aluminum, or stainless steel.

The conductive adhesive layer 7B is formed by applying adhesive material, in which conductive particles are dispersed, onto one surface of the metallic foil 7A.

Examples of the adhesive material include epoxy or phenolic resin containing hardener, acrylic adhesive compound, rubber adhesive compound, silicone adhesive compound and the like.

Conductive materials of any type having good electrical continuities may be employed as the conductive particles to be dispersed in the adhesive. Examples include metallic powder of, for example, copper, silver, and nickel. metallic oxide powder of, for example, tin oxide, tin indium oxide, and zinic oxide, and resin or ceramic powder coated with such a metal or metallic oxide as mentioned above. There is no specific limitation on its configuration so that the particles may have any configuration such as palea-like, dendritic, granular, pellet-like, spherical, stellar, or confetto-like (spherical with many projections) configuration.

The content of the conductive particles is preferably 0.1–15% by volume relative to the adhesive and the average particle size is preferably 0.1–100 $\mu$m.

The thickness of the adhesive layer 7B is in a range from 5 to 100 $\mu$m in a normal case.

Examples of material of the transparent base plate 2 include glass, polyester, polyethylene terephthalate (PEI), polybutylene terephthalate, polymethyl methacrylate (PMMA), acrylic board, polycarbonate (PC), polystyrene, triacetate film, polyvinyl alcohol, polyvinyl chloride, polyvinylidene chloride, polyethylene, ethylene-vinyl acetate copolymer, polyvinyl butyral, metal ionic cross-linked ethylene-methacrylic copolymer, polyurethane, and cellophane. Preferably selected from the above materials are glass, PET, PC, and PMMA.

The thickness of the transparent base plate 2 is suitably determined in accordance with requirements (e.g. strength, light weight) due to the application of a plate to be obtained and are normally in a range from 0.1 to 10 mm.

An anti reflection film 6 is formed on the surface of the transparent base plate 2. The antireflection film 6 formed on the surface of the transparent base plate 2 is a laminated film of a high-refractive transparent film and a low-refractive transparent film and examples of the laminated film are as follows:

(a) a laminated film consisting of a high-refractive transparent film and a low-refractive transparent film, i.e. two films in total;

(b) a laminated film consisting of two high-refractive transparent films and two low-refractive transparent films which are alternately laminated, i.e. four films in total;

(c) a laminated film consisting of a medium-refractive transparent film, a high-refractive transparent film, and a low-refractive transparent film, i.e. three films in amount; and (d) a laminated film consisting of three high-refractive transparent films and three low-refractive transparent films which are alternately laminated, i.e. six films in total.

As the high-refractive transparent film, a film, preferably a transparent conductive film, having a refractive index of 1.8 or more can be made of ZnO, $TiO_2$, $SnO_2$, or ZrO in which ITO (tin indium oxide) or ZnO, Al is doped. On the other hand, as the low-refractive transparent film, a film can be made of low-refractive material having a refractive index of 1.6 or less such as $SiO_2$, $MgF_2$, or $Al_2O_3$. The thicknesses of the films vary according to the film structure, the film kind, and the central wavelength because the refractive index in a visible-light area is reduced by interference of light. In case of four-layer structure, the anti reflection film is formed in such a manner that the first layer (high-refractive transparent film) is from 5 to 50 nm, the second layer (low-refractive transparent film) is from 5 to 50 nm, the third layer (high-refractive transparent film) is from 60 to 100 nm, and the fourth layer (low-refractive transparent film) is from 50 to 150 nm in thickness.

The antireflection film 6 may be further formed with an antifouling film to improve the fouling resistance of the surface. The antifouling film is preferably a fluorocarbon or silicone film having a thickness in a range from 1 to 1000 nm.

The transparent base plate 2 as the front surface may be further processed by hard coating with silicone material and/or anti-glare finish by hard coating including light-scattering agent.

It is preferable that the conductive mesh member 3, made of metallic fibers and/or metal-coated organic fibers has a wire diameter between 1 $\mu$m and 1 mm and an open area ratio between about 50% and about 90%. When the wire diameter is more than 1 mm, the open area ratio is reduced or the electromagnetic-wave shielding efficiency is reduced and it is impossible to satisfy the open area ratio and the electromagnetic-wave shielding efficiency. When the wire diameter is less than 1 $\mu$m, it reduces the strength of the mesh member to make the handling significantly difficult. When the open area ratio is more than 90%, it is difficult to maintain the mesh configuration. On the other hand, when the open area ratio is less than 50%, too low light transmittance is provided so as to reduce the light from the display. It is-more preferable that the wire diameter is between 10 and 500 $\mu$m and the open area ratio is between 60 and 90%.

The ratio of opening areas of the conductive mesh member means the ratio of areas, where the openings occupy, relative to the projected area of the conductive mesh member.

Examples of metal of metallic fibers and metal-coated organic fibers constituting the conductive mesh member include copper, stainless steel, aluminum, nickel, titanium, tungsten, tin, zinc, lead, iron, silver, chrome, carbon, or alloy thereof. Preferably selected from the above are copper, stainless steel, and aluminum.

Examples of organic material of the metal-coated organic fibers include polyester, nylon, vinylidene chloride, aramid, vinylon, and cellulose.

In this invention, since the margins of the conductive mesh member are folded, the conductive mesh member is preferably made of metallized organic fibers having high toughness.

As the heat-ray blocking film 5, a film comprising a base film on which a heat-ray blocking coating of zinc oxide or silver thin film is applied may be employed. In this case, the base film is preferably made of PET, PC, of PMMA. The thickness of the film is preferably set in a range from 10 $\mu$m to 20 mm to prevent the thickness of the resultant display panel from being too thick to ensure its easy handling and its durability. The thickness of the heat-ray blocking coating, which is formed on this base film, is usually from 500 Å to 5000 Å.

As the heat-ray blocking film 5, a film comprising a base film on which oxide transparent conductive films and metal thin films are laminated alternatively may be also preferably employed.

As the base film, a film made of PET, PC, or PMMA the same as mentioned above may be employed. The thickness of the film is preferably set in a range from 1 $\mu$m to 5 mm to prevent the thickness of the resultant display panel from being too thick to ensure its easy handling and its durability.

As the oxide transparent conductive film which is formed on this base film, a thin film made of, for example, tin indium oxide (ITO), ZnO, ZnO in which Al is doped, and $SnO_2$ may be formed and its thickness is usually in a range of 5–5000 Å.

And as the metal thin film, a pure thin film such as silver, copper, aluminum, nickel, gold, platinum, and chromium or an alloy thin film such as brass, stainless steel may be formed in such a thickness as not to lose its light transparency and the thickness therefore is usually in a range of 2–2000 Å.

When the number of laminations of the oxide transparent conductive films and the metal films is too small, sufficient electromagnetic-wave shielding efficiency and heat-ray blocking efficiency are not obtained. On the other hand, when the number is too large, transparency is lost. Preferable number of laminations is 1–20 for each kind, i.e. 2–40 in total.

These oxide transparent conductive films and the metal films can be formed easily on the base film by one of methods including sputtering, vacuum evaporation, ion plating, and CVD (chemical vapor deposit). Among them, sputtering by which it is easy to control the thickness is preferable.

In the present invention, examples of adhesive resins for bonding the transparent base plate 2, the conductive mesh member 3, the heat-ray blocking film 5, and the PDP body 20 include copolymers of ethylene group, such as ethylene-vinyl acetate copolymer, ethylene-methyl acrylic copolymer, ethylene-(meth) acrylic copolymer, ethylene-ethyl (meth) acrylic copolymer, ethylene-methyl (meth) acrylic-copolymer, metal ionic cross-linked ethylene-(meth) acrylic copolymer, partial saponified ethylene-vinyl acetate copolymer, calboxylated ethylene-vinyl acetate copolymer, ethylene-(meth) acrylic-maleic anhydride copolymer, and ethylene-vinyl acetate-(meth) acrylate copolymer. It should be noted that "(meth) acrylic" means "acrylic or meth-acrylic".

In the present invention, a transparent adhesive resin having elasticity is preferably used as the adhesive resin. Examples as the transparent adhesive resin include adhesive resins normally used as adhesives for laminated glasses. The best one among them is ethylene-vinyl acetate copolymer (EVA) because it can offer the best balance of performance and can be easily handled. In terms of the impact resistance, the perforation resistance, the adhesive property, and the transparency, PVB resin often used for laminated safety glasses for automobile is also preferable.

EVA in which the contents of vinyl acetate is between 5 and 50% by weight, preferably between 15 and 40% by weight, is employed. Less than 5% by weight of vinyl acetate interferes with the weatherability and the transparency, while exceeding 40% by weight of vinyl acetate significantly reduces mechanical characteristics, makes the film forming difficult, and produce a possibility of blocking between films.

Suitably employed as the crosslinking agent when the EVA is crosslinked by heating is organic peroxide which is selected according to the temperature for sheet process, the temperature for crosslinking agent, and the storage stability. Examples of available peroxide includes 2,5-dimethylhexane-2,5-dihydro peroxide; 2,5-dimethyl-2,5-di (tert-butyl-peroxy)-hexane-3; di-tert-butyl peroxide; tert-butylcumyl peroxide; 2,5-dimethyl-2,5-di(tert-butyl-peroxy)-hexane; dicumyl peroxide; α, α'-bis(tert-butyl peroxy)-benzene; n-buthyl-4,4-bis(tert-butyl-peroxy)-valerate; 2,2-bis(tert-butyl-peroxy)-butane, 1,1-bis(tert-butyl-peroxy)-cyclohexane; 1,1-bis(tert-butyl-peroxy)-3,3,5-trimethylcyclohexane; tert-butyl peroxy benzoate; benzoyl peroxide; tert-butyl peroxy acetate; 2,5-dimethyl-2,5-bis(tert-butyl-peroxy)-hexyne-3; 1,1-bis(tert-butyl-peroxy)-3,3,5-trimethylcyclohexane; 1,1-bis(tert-butyl-peroxy)-cyclohexane; methyl ethyl ketone peroxide; 2,5-dimethylhexyl-2,5-bis-peroxy-benzoate; tert-butyl-hydroperoxide; p-menthane hydroperoxide; p-chlorbenzoyl peroxide; tert-butyl peroxyisobutyrate; hydroxyheptyl peroxide; and chlorohexanon peroxide. These are used alone or in mixed state, normally less than 5 parts by weight, preferably from 0.5 to 5.0 parts by weight per 100 parts by weight of EVA.

The organic peroxide is normally mixed to the EVA by an extruder or a roll mill or may be added to the EVA film by means of impregnation by dissolving the peroxide into organic solvent, plasticizer, or vinyl monomer.

In order to improve the properties (such as mechanical strength, optical property, adhesive property, weatherability, blushing resistance, and crosslinking speed) of the EVA, a compound containing one selected from acryloxy group or methacryloxy group and one selected from allyl group may be added into the EVA. Such a compound used for this purpose is usually acrylic acid or methacrylic acid derivative, for example, ester or amide thereof Examples of ester residues include alkyl group such as methyl, ethyl, dodecyl, stearyl, and lauryl and, besides such alkyl group, cycloxyhexyl group, tetrahydrofurfuryl group, aminoethyl group, 2-hydroethyl, 3-hydroxypropyl group, and 3-chloro-2-hydroxypropyl group. Ester with polyfunctional alcohol such as ethylene glycol, triethylene glycol, polyethylene glycol, trimethylolpropane, or pentaerythritol may be also employed. The typical amide is diacetone acrylamide.

More concretely, examples includes compounds containing polyfunctional ester such as acrylic ester or methacrylate such as trimethylolpropane, pentaerythritol and glycerin, or allyl group such as triallyl cyanurate, triallyl isocyanurate, diallyl phthalate, diallyl isophthalate, and diallyl maleate. These are used alone or in the mixed state, normally from 0.1 to 2 parts by weight, preferably from 0.5 to 5 parts by weight per 100 parts by weight of EVA.

When the EVA is crosslinked by light, photosensitizer is used instead of the above peroxide, normally less than 5 parts by weight, preferably from 0.1 to 3.0 parts by weight per 100 parts by weight of EVA.

In this case, examples of available photosensitizer include benzoin; benzophenone; benzoin methyl ether; benzoin ethyl ether; benzoin isopropyl ether; benzoin isobutyl ether; dibenzyl; 5-nitroaniline; hexachlorocyclopentadiene; p-nitrodiphenyl; p-nitroaniline; 2,4,6-trinitroaniline; 1,2-benzanthraquinone; and 3-methyl-1,3-diazo-1,9-benzanthrone. These can be used either alone or in the mixed state.

In this case, silane coupling agent is further used as adhesive accelerator. Examples of the silane coupling agent include vinyltriethoxysilane, vinyl-tris (β-methoxyethoxy) silane, γ-methacryloxypropyl trimethoxy silane, vinyltriacetoxy silane, γ-glycidoxypropyltrimetoxysilane, γ-glycidoxypropyltrietoxysilane, β-(3,4-epoxycyclohexyl) ethyl trimethoxy silane, γ-chloropropyl methoxy silane, vinyltrichlorosilane, γ-mercaptopropyl trimethoxy silane, γ-aminopropyl triethoxy silane, and N-(β-aminoethyl)-γ-aminopropyl trimethoxy silane.

These are used alone or in the mixed state, normally from 0.001 to 10 parts by weight, preferably from 0.001 to 5 parts by weight per100 parts by weight of EVA.

It is preferable that the PVB resin contains polyvinyl acetal between 70 and 95% by unit weight and polyvinyl acetate between 1 and 15% by unit weight, and has an average degree of polymerization between 200 and 3000, preferably 300 and 2500. The PVB resin is used as resin composition containing plasticizer.

Examples of plasticizer in the PVB resin composition include organic plasticizers, such as monobasic acid ester and polybasic acid ester, and phosphoric acid plasticizers.

Preferable examples of such monobasic acid ester are ester as a result of reaction of organic acid, such as butyric acid, isobutyric acid, caproic acid, 2-ethylbutyric acid, heptoic acid, n-octyl acid, 2-ethylhexyl acid, pelargonic acid (n-nonyl acid), or decyl acid, and triethylene glycol and, more preferably, are triethylene-di-2-ethylbthyrate, triethylene glycol-di-2-ethylhexoate, triethylene glycol-di-caproate, and triethylene glycol-di-n-ocotoate. Ester of one of the above organic acids and tetraethylene glycol or tripropylene glycol may be also employed.

Preferable examples of plasticizers of polybasic acid ester group are ester of organic acid, such as adipic acid, sebacic acid, or azelaic acid, and straight chain like or brunch like alcohol with from 4 to 8 carbon atoms and, more preferably, are dibutyl sebacate, dioctyl acetate, and dibutyl carbitol adipate.

Examples of phosphoric acid plasticizers include tributoxyethyl phosphate, isodecyl phenyl phosphate, and triisopropyl phosphate.

Insufficient plasticizer in the PVB resin composition reduces the film-forming property, while excessive plasticizer spoils the durability during high temperature. Therefore, the amount of plasticizer in the PVB resin composition is between 5 and 50 parts by weight, preferably between 10 and 40 parts by weight, per 100 parts by weight of polyvinyl butyral resin.

The resin composition of the intermediate adhesive layers according to the present invention may further include, in small amounts, stabilizer, antioxidant, ultraviolet absorbing agent, infrared absorbing agent, antioxidant, paint processing aid, and/or coloring agent for preventing degradation. If necessary, it may still further include, in small amounts, filler such as carbon black, hydrophobic silica and calcium carbonate.

It is also effective that the intermediate adhesive layers in sheet condition are surfaced by corona discharge process, low temperature plasma process, electron beam irradiation process, or ultraviolet irradiation. process as measures of improving the adhesive property.

The intermediate adhesive layers according to the present invention can be manufactured for example, by first mixing the EVA or PVB and the additives listed above, kneading them by an extruder or a roll, and after that, forming in a predetermined configuration by means of a film forming method such as calendering, rolling, T-die extrusion, or inflation. During the film formation, embossing is provided for preventing the blocking between sheets and facilitating the deaerating during compressed onto the transparent base plate or the front board of the PDP body.

The intermediate adhesive layers 4A, 4B, 4C, for example, formed in sheet configuration are used, and the conductive mesh member 3 and the heat-ray blocking film 5 are put between the intermediate adhesive layers 4A, 4B, 4C to make a pre-assembled unit. The pre-assembled unit is interposed between transparent base plate 2 and the PDP body 20 and, after pre-compression bonding by deaerating them in vacuumed and warmed conditions, it is heated or radiated with light to harden the adhesive layer so as to form an assembled unit. In this manner, the display panel of the present invention as mentioned above can be manufactured easily.

The intermediate adhesive layers 4A, 4B, 4C are molded to have thickness from 1 $\mu$m to 1 mm preventing the thickness of the adhesive layer from being too thick.

The conductive mesh member 3 which is made wider than transparent base plate 2 so that the periphery of the conductive mesh member 3 is positioned out of the peripheral edges of transparent base plate 2. The size of the transparent mesh member 3 is preferably set in such a manner that the width of the margins laid on the transparent base plate 2 is in a range from 3 to 20 mm.

After the transparent base plate 2, the conductive mesh member 3, the heat-ray blocking film 5, and the PDP body 20 are integrated, the margins of the conductive mesh member 3 are folded back and the conductive adhesive tape 7 is wound around the periphery of the assembled unit to fix the margins and then they are bonded together by thermo compression bonding according to the hardening method of used conductive adhesive tape 7.

In this manner, the display panel 1 with the conductive adhesive tape 7 can be simply and easily built in the body of equipment just by inlaying in the body of equipment. In addition, good conduction between the conductive mesh member 3 and the body of equipment, can be provided uniformly along the circumferential direction through the conductive adhesive tape 7.

Therefore good electromagnetic-wave shielding efficiency can be obtained.

The display panel shown in FIG. 1 is one of examples of the display panel of the first aspect and the first aspect is not limited thereto. For example, while the four side edges of the conductive mesh member 3 are positioned out of the transparent base plate 2 and folded back in the illustrative embodiment, only two side edges opposite to each other may be positioned out of the transparent base plate 2 and folded back.

While the heat-ray blocking film is interposed between the transparent base plate and the PDP body in the illustrative embodiment, a heat-ray blocking film may be formed directly on the front board of the PDP body. It is also acceptable to integrate an electromagnetic-wave shielding layer with a heat-ray blocking layer.

In the first aspect, as the conductive mesh member, a conductive composite mesh member, in which metallic fibers and/or metal-coated organic fibers and organic fibers are woven, may be employed.

As for the conductive composite mesh member, a reduced open area ratio is provided when the line width is more than 200 $\mu$m, the configuration can not be maintained when the line width is less than 1 $\mu$m with a small mesh size, and a reduced open area ratio is also provided when the line width is less than 1 $\mu$m with a large mesh size. It is preferable that the line width is between 1 and 200 $\mu$m and more preferable that it is between 5 and 100 $\mu$m. No shielding efficiency is provided when the open area ratio (the ratio of opening areas relative to the projected area of the mesh member) is 100%, and the luminance from the PDP body 20 is reduced when the open area ratio is less than 30%. It is preferable that the open area ratio is between 30 and 99.9% and more preferable that it is between 40 and 90%.

Examples as metal of the metallic fibers or metal-coated organic fibers constituting the conductive composite mesh member, include copper, stainless steel, aluminum, nickel, chromium titanium, tungsten, tin, lead, iron, silver, carbon, or alloy thereof. Preferably selected from the above are copper, stainless steel, and aluminum.

Examples as organic material or organic fibers of the metal-coated organic fibers include polyester, nylon, vinylidene chloride, aramid, vinylon, and cellulose.

As for the conductive composite mesh member according to the present invention, in case of too much metallic fibers and/or metal-coated fibers and less organic fibers, effect obtained by using organic fibers can not be sufficiently obtained. On the other hand, in case of too much organic fibers and less metallic fibers and/or metal-coated fibers, electromagnetic-wave shielding efficiency is reduced. Therefore, the ratio of the metallic fibers and/or the metal-coated fibers and the organic fibers is preferably, Metallic fibers and/or Metal-coated fibers: Organic fibers=1:1–1:10 (ratio by the number of fibers).

Therefore, the conductive composite mesh member is formed by weaving the metallic fibers and/or the metal-coated fibers and the organic fibers at the above ratio in such a manner that these fibers are dispersed uniformly.

Figure 7:
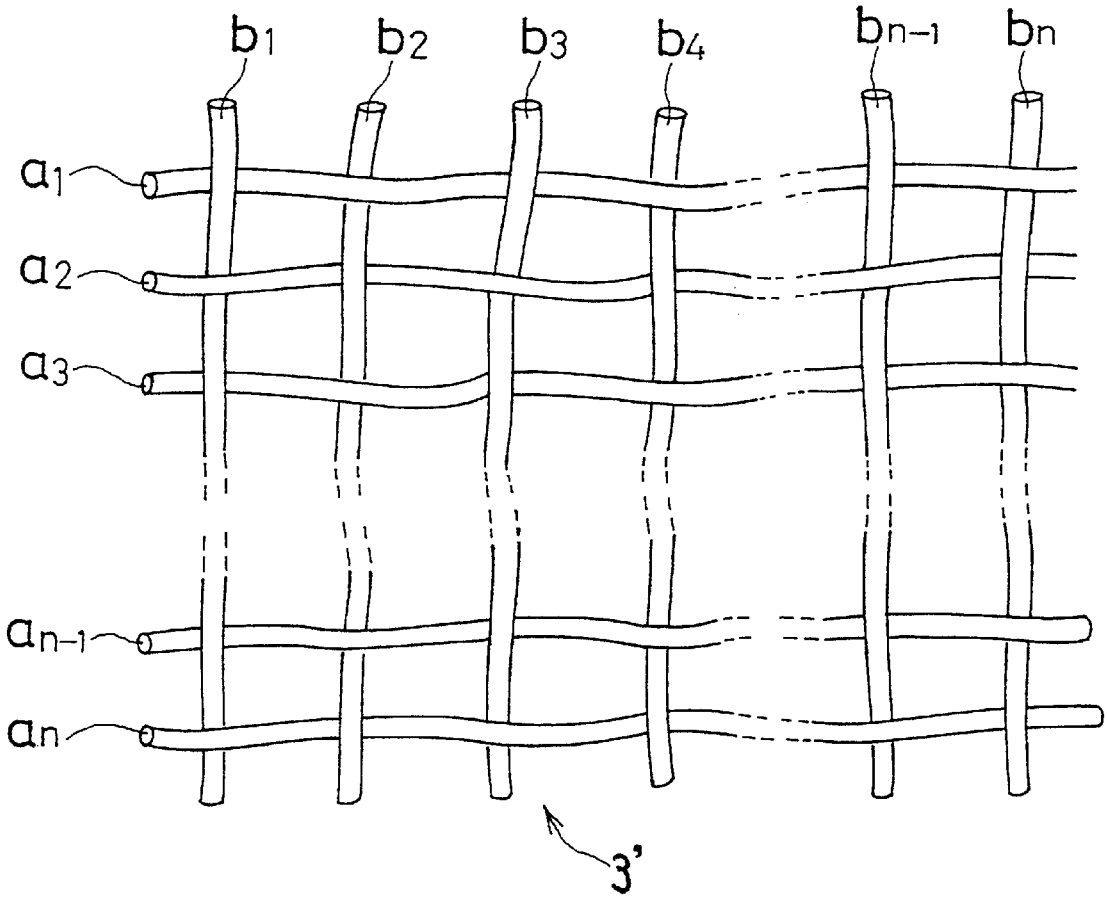
FIG. 7 is an enlarged schematic illustration of a conductive composite mesh member according to the fifth aspect.

Following are examples of fiber patterns of the conductive composite mesh member 3' in FIG. 7 showing the enlarged fibers of conductive composite mesh member.

(i) $a_1, a_3, \ldots a_{2m+1}$ and $b_1, b_3, \ldots b_{2m+1}$=Metallic fibers and/or Metal-coated fibers, $a_2, a_4, \ldots a_{2m}$ and $b_2, b_4, \ldots b_{2m}$=Organic fibers;

(ii) $a_1, a_4, \ldots a_{3m+1}$ and $b_1, b_4, \ldots b_{3m+1}$=Organic fibers, others=Metallic fibers and/or Metal-coated fibers; and (iii) $a_1, a_4, \ldots a_{3m+1}$ and $b_1, b_4, \ldots b_{3m+1}$=Metallic fibers and/or Metal-coated fibers, others=Organic fibers.

And also in this case, the conductive composite mesh member utilizing metal-coated organic fibers with high toughness and organic fibers is preferable, because edges of the conductive composite mesh member have to be folded back.

In the display panel of the first aspect, by utilizing a PDP which is integrated with electromagnetic-wave shielding material, electromagnetic-wave shielding efficiency is imparted to the display panel itself, thereby lightening its weight, making its wall thinner, reducing the number of parts, and thus improving the productivity and reducing the cost. In addition, it can prevent the malfunction of a remote controller.

By using the conductive composite mesh member having a high degree of freedom for pattern as electromagnetic-wave shielding material, it is able to obtain electromagnetic-wave shielding efficiency and light transparency as desired and to provide distinct pictures by preventing the moiré phenomenon.

In case of integrating the heat-ray blocking layer to the display panel, it can obtain electromagnetic-wave shielding efficiency as well as heat-ray blocking efficiency and also can reduce radiant heat from the display part.

Besides, in case of using transparent elastic adhesives for bonding, the safety can be improved by preventing scattering of fragments when damaged.

Hereinafter, an embodiment of the second aspect of the present invention will be described in detail with reference to FIGS. 2, 3.

Figure 2:
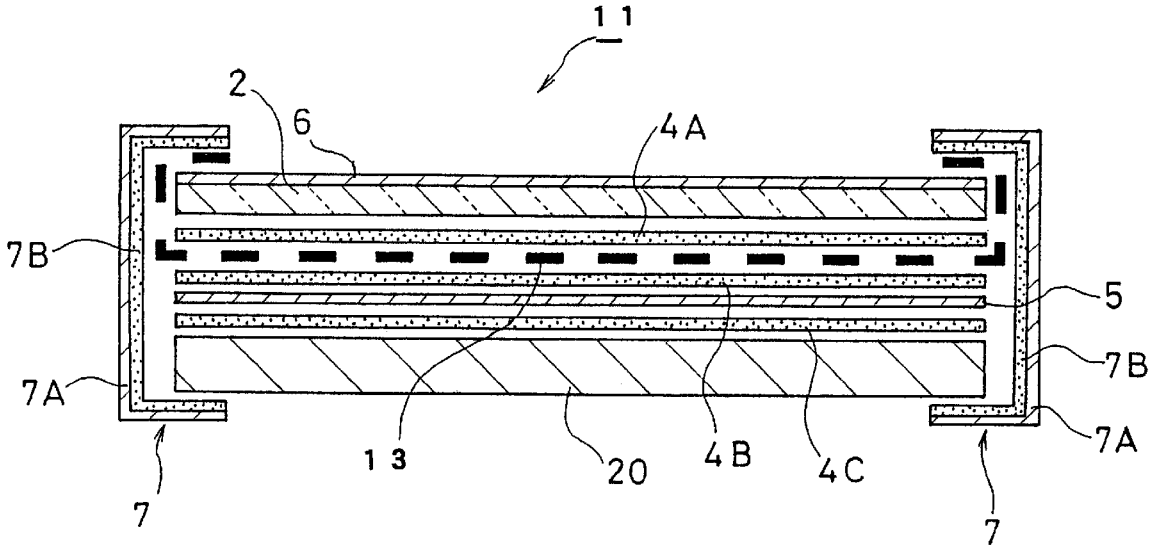
FIG. 2 is a schematic sectional view showing an embodiment of a display panel of the second aspect.

FIG. 2 is a schematic sectional view showing an embodiment of the display panel of the second aspect and FIGS. 3A through 3F are top plan views showing examples of etching patterns.

This display panel 11 comprises a transparent base plate 2, a PDP body 20 (any of typical PDPs such as the PDP having the structure as shown in FIG. 9), a metallic foil 13, and a heat-ray blocking film 5. The metallic foil 13 and the heat-ray blocking film 5 are interposed between the transparent base plate 2 and the PDP body 20 and are bonded together using intermediate adhesive layers 4A, 4B, 4C as adhesives so as to form an assembled unit. The periphery of the pattern-etched metallic foil 13 is positioned outside of peripheral edges of the transparent base plate 2 so as to form margins which are folded along the peripheral edges of transparent base plate 2 and bonded to the transparent base plate 2 by a conductive adhesive tape 7.

In this embodiment, the conductive adhesive tape 7 adheres to all around ends of the assembled unit of the transparent base plate 2, the pattern-etched metallic foil 13, the heat-ray blocking film 5, and the PDP body 20 and also adheres to outer edges of both surfaces of the assembled unit, i.e. outer edges of the front surface of the transparent base plate 2 and outer edges of the rear surface of the PDP body 20.

In the second aspect, the conductive adhesive tape 7, the transparent base plate 2, an anti-reflection coating 6 formed on the surface of the transparent base plate 2 may be the same as described in the first aspect. The same is true for the soil resistant coating, the hard coating or anti-glare finish.

As material of the metallic foil 13, copper, stainless steel, aluminum, nickel, iron, brass or alloy thereof may be used. Preferably selected from them are copper, stainless steel, and aluminum.

It is not preferable that the metallic foil 13 is too thin in view of the handling and the working of pattern etching and it is also not preferable that the metallic foil is too thick because it affects the thickness of the display panel to be obtained and makes time for etching process longer. Therefore, the thickness of the metallic foil is preferably in a range from 1 to 200 $\mu$m.

A method of pattern etching such a metallic foil may be any one of commonly used methods and is preferably a photoetching using a resist. In this case, a resist pattern is formed by first coating the metallic foil with the photo-resist, exposing a pattern using a desired mask, and then developing the pattern. After that, metallic foil excepting places where the resist exists is removed by etchant such as ferric chloride.

The use of pattern etching can provide a high degree of freedom for pattern so that the metallic foil can be etched in any line width, space, and opening configuration, thereby preventing the moiré phenomenon, and allowing easy formation of electromagnetic-wave shielding material having desired electromagnetic-wave shielding efficiency and light transparency.

Figure 3A:
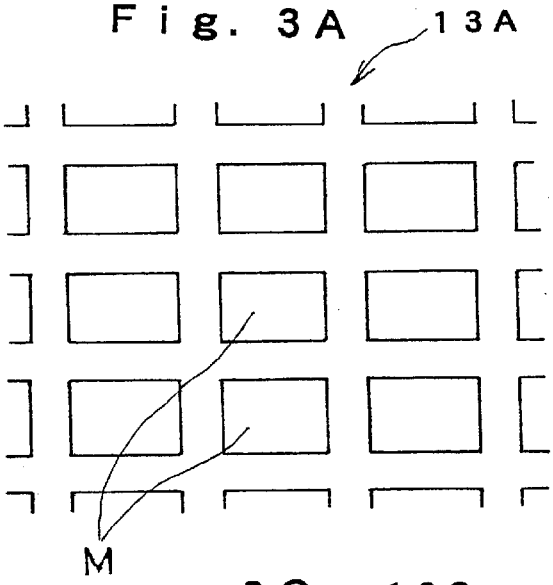
FIG. 3A, FIG. 3B, FIG. 3C, FIG. 3D, FIG. 3E, and FIG. 3F are top plan views showing examples of etching patterns or printing patterns.
Figure 3B:
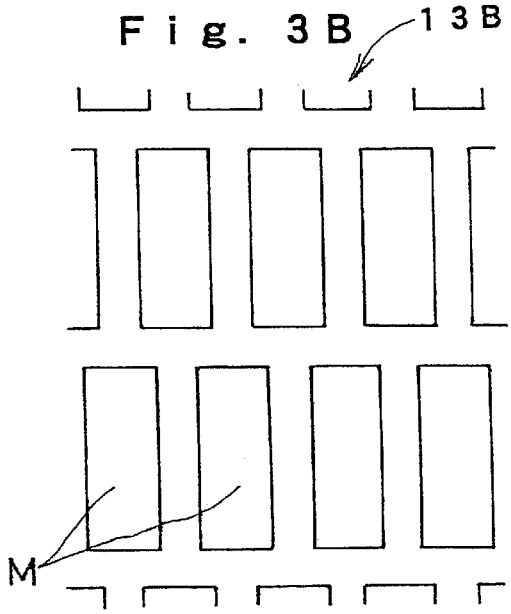
Figure 3C:
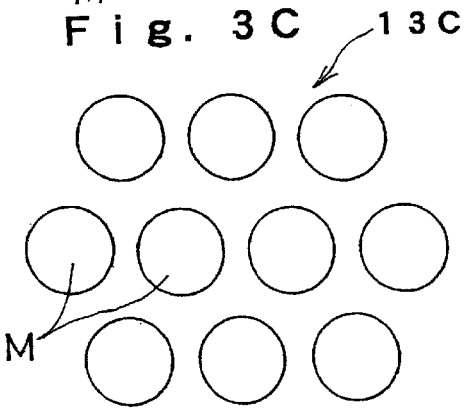
Figure 3D:
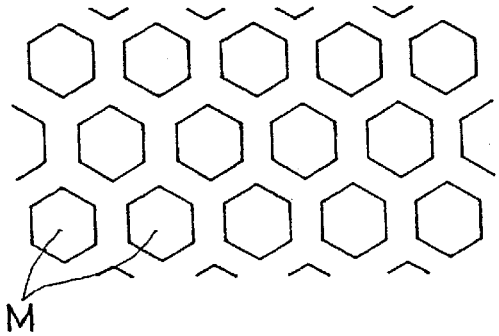
Figure 3E:
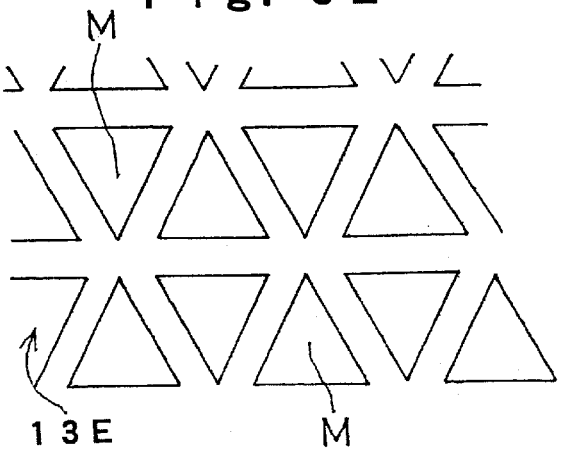
Figure 3F:
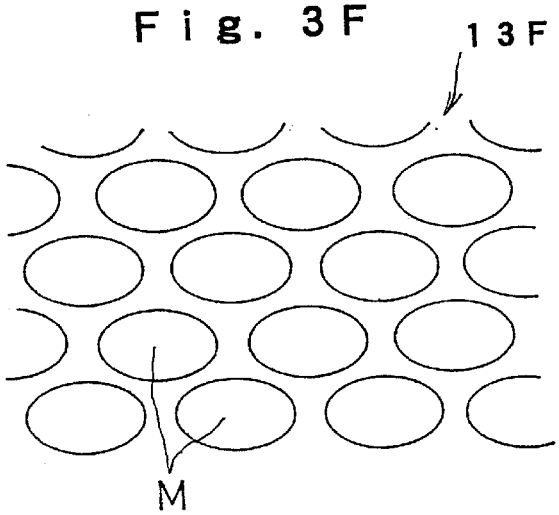

In the second aspect, the configuration of etching pattern of the metallic foil is not particularly limited. Examples include metallic foils 13A, 13B each formed in a lattice arrangement having rectangular openings M as shown in FIG. 3A and FIG. 3B and metallic foils 13C, 13D, 13E, 13F each formed in a punching metal-like arrangement having circular, hexagon, triangle, or elliptical openings M as shown in FIGS. 3C, FIG. 3D, FIG. 3E and FIG. 3F. Besides the arrangements in which the openings M are regularly arranged, an arrangement in which openings M are randomly arranged may be used to prevent the moiré phenomenon.

In order to ensure the electromagnetic-wave shielding efficiency and the light transparency, the ratio of opening areas of the metallic foil relative to the projected area of the metallic foil (hereinafter, referred to as "open area ratio") is preferably in a range from 20 to 90%.

When the metallic foil is designed to have a greater open area ratio in order to improve the light transparency, a transparent conductive layer may be formed onto the transparent base plate 2, the front surface of the PDP body 20, or the beat-ray blocking film 5 to compensate a shortage of electromagnetic-wave shielding efficiency of the metallic foil 13.

The heat-ray blocking film 5 may be the same as described in the first aspect mentioned above and the adhesive resin for bonding the transparent base plate 2, the pattern-etched metallic foil 13, the heat-ray blocking film 5, and the PDP body 20 together may also be the same as the adhesive resin or preferably the transparent elastic adhesive resin described in the first aspect.

The intermediate adhesive layers 4A, 4B, 4C as adhesives, for example, formed in sheet configuration are used, and the pattern-etched metallic foil 13 and the heat-ray blocking film 5 are put between the intermediate adhesive layers 4A, 4B, 4C to make a pre-assembled unit. The pre-assembled unit is interposed between transparent base plate 2 and the PDP body 20 and, after pre-compression bonding by deaerating them in vacuumed and warmed conditions, is heated or radiated with light to harden the adhesive layer so as to form an assembled unit. In this manner, the display panel shown in FIG. 2 can be manufactured easily.

The intermediate adhesive layers 4A, 4B, 4C are molded to have thickness from 1 $\mu$m to 1 mm preventing the thickness of the adhesive layer from being too thick.

The pattern-etched metallic foil 13 which is made wider than transparent base plate 2 so that the periphery of the metallic foil 13 is positioned out of the peripheral edges of transparent base plate 2. The size of the pattern-etched metallic foil 13 is preferably set in such a manner that the width of the margins laid on the transparent base plate 2 is in a range from 3 to 20 mm.

After the transparent base plate 2, the pattern-etched metallic foil 13, the heat-ray blocking film 5, and the PDP body 20 are integrated, the margins of the metallic foil 13 are folded back and the conductive adhesive tape 7 is wound around the periphery of the assembled unit to fix the margins and then they are bonded together by thermo compression bonding according to the hardening method of used conductive adhesive tape 7.

In this manner, the display panel 11 with the conductive adhesive tape 7 can be simply and easily built in the body of equipment just by inlaying in the body of equipment. In addition, good conduction between the pattern-etched metallic foil 13 and the body of equipment can be provided uniformly along the circumferential direction through the conductive adhesive tape 7. Therefore good electromagnetic-wave shielding efficiency can be obtained.

The display panel shown.in FIG. 2 is one of examples of the display panel of the second aspect and the second aspect is not limited thereto. For example, while the four side edges the pattern-etched metallic foil 13 are positioned out of the transparent base plate 2 and folded back in the illustrative embodiment, only two side edges opposite to each other may be positioned out of the transparent base plate 2 and folded back.

In the display panel of the second aspect, by utilizing a PDP which is integrated with electromagnetic-wave shielding material, electromagnetic-wave shielding efficiency is imparted to the display panel itself, thereby lightening its weight, making its wall thinner, reducing the number of parts, and thus improving the productivity and reducing the cost. In addition, it can prevent the malfunction of a remote controller.

Since the pattern-etched conductive foil is used as the electromagnetic-wave shielding material in the second aspect, it is able to obtain electromagnetic-wave shielding efficiency and light transparency as desired by selecting the etching pattern and to provide distinct pictures by preventing the moiré phenomenon.

Hereinafter, an embodiment of the third aspect of the present invention will be described in detail with reference to FIG. 4.

Figure 4:
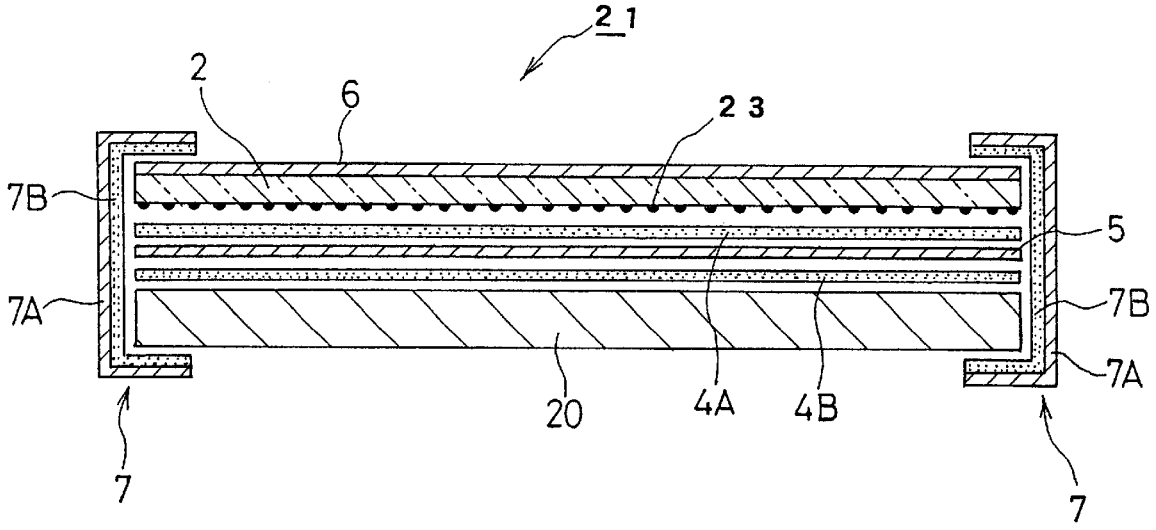
FIG. 4 is a schematic sectional view showing an embodiment of a display panel of the third aspect.

FIG. 4 is a schematic sectional view showing an embodiment of the display panel of the third aspect of the present invention.

This display panel 21 comprises a transparent base plate 2 on which a pattern-etched metallic film 23 is formed at the bonding side, a PDP body 20 (any of typical PDPs such as the PDP having the structure as shown in FIG. 9), and a heat-ray blocking film 5 which is interposed between the transparent base plate 2 and the PDP body 20 by using intermediate adhesive layers 4A, 4B and integrated together.

In this embodiment, the conductive adhesive tape 7 adheres to all around ends of the assembled unit of the transparent base plate 2, the heat-ray blocking film 5, and the PDP body 20 and also adheres to outer edges of both surfaces of the assembled unit, i.e. outer edges of the front surface of the transparent base plate 2 and outer edges of the rear surface of the PDP body 20.

In the third aspect, the conductive adhesive tape 7, the transparent base plate 2, an anti-reflection coating 6 formed on the surface of the transparent base plate 2 may be the same described in the first aspect. The same is true for the soil resistant coating, the hard coating or anti-glare finish.

As material of the metallic film 23 formed on the transparent base plate 2 at the bonding side, copper, stainless steel, chromium, aluminum, nicklel, iron, brass, or alloy thereof may be used. Preferably selected from them are copper, stainless steel, aluminum, and chrome.

The metallic film 23 can be formed easily on the base plate by one of methods including electroless plating, vacuum evaporation, sputtering, and chemical vapor deposit.

It is not preferable that the metallic film 23 is too thin because the electromagnetic-wave shielding efficiency becomes insufficient and it is also not preferable that the metallic film is too thick because it affects the thickness of the display panel to be obtained and makes a time period for etching process longer. Therefore, the thickness of the metallic film is preferably in a range from 0.01 to 50 $\mu$m.

A method of pattern etching such a metallic film may be any one of commonly used methods and is preferably a photoetching using a resist. In this case, a resist pattern is formed by first coating the metallic film with the photoresist, exposing a pattern using a desired mask, and then developing the pattern. After that, metallic film excepting places where the resist exists is removed by etchant such as ferric chloride.

The use of pattern etching can provide a high degree of freedom for pattern so that the metallic film can be etched in any line width, space, and opening configuration, thereby preventing the moiré phenomenon, and allowing easy formation of the conductive layer having desired electromagnetic-wave shielding efficiency and light transparency.

In the third aspect, the configuration of etching pattern of the metallic foil is not particularly limited. Examples include metallic films each formed in a lattice arrangement having rectangular openings M and metallic films each formed in a punching metal-like arrangement having circular, hexagon, triangle, or elliptical openings M as shown in FIGS. 3A through 3F which are described above with respect to the etching patterns of the metallic foil of the second aspect. Besides the arrangements in which the openings M are regularly arranged, an arrangement in which openings M are randomly arranged may be used to prevent the moiré phenomenon.

In order to ensure the electromagnetic-wave shielding efficiency and the light transparency, the ratio of opening areas of the metallic film relative to the projected area of the metallic film (hereinafter, referred to as "open area ratio") is preferably in a range from 20 to 90%.

When the metallic film is designed to have a greater open area ratio in order to improve the light transparency, a transparent conductive layer may be formed onto the transparent base plate 2, the front surface of the PDP body 20, or the heat-ray blocking film 5 to compensate a shortage of electromagnetic-wave shielding efficiency of the metallic film 23:

The heat-ray blocking film 5 may be the same as described in the first aspect mentioned above and the adhesive resin for bonding the transparent base plate 2 on which the pattern-etched metallic film 23 is formed, the heat-ray blocking film 5, and the PDP body 20 together may also be the same as the adhesive resin or preferably the transparent elastic adhesive resin described in the first aspect.

The intermediate adhesive layers 4A, 4B as adhesives, for example, formed in sheet configuration are used, and the heat-ray blocking film 5 are put between the intermediate adhesive layers 4A, 4B to make a pre-assembled unit. The pre-assembled unit is interposed between transparent base plate 2, on which the metallic film 23 is previously formed at the bonding side by pattern etching, and the PDP body 20 and, after pre-compression bonding by deaerating them in vacuumed and warmed conditions, it is heated or radiated with light to harden the adhesive layers so as to form an assembled unit. In this manner, the display panel 21 shown in FIG. 4 can be manufactured easily.

The intermediate adhesive layers 4A, 4B are molded to have thickness from 1 $\mu$m to 1 mm preventing the thickness of the adhesive layer from being too thick.

After the transparent base plate 2, the heat-ray blocking film 5, and the PDP body 20 are integrated, the conductive adhesive tape 7 is wound around the periphery of the assembled unit and fixed and then they are bonded together by thermo compression bonding according to the hardening method of used conductive adhesive tape 7.

In order to ensure the conduction between the conductive adhesive tape 7 and the metal membrane 23, a conductive tape is preferably provided around the periphery of transparent base plate 2, on which the metallic film 23 is formed, to outwardly extend from the assembled unit and also the extending portion of the conductive tape is bonded to the sides of the assembled unit with the conductive adhesive tape 7 so as to provide a conductive parts.

In this manner, the display panel 21 with the conductive adhesive tape 7 can be simply and easily built in the body of equipment just by inlaying in the body of equipment. In addition, good conduction between the pattern-etched metallic film 23 and the body of equipment can be provided uniformly along the circumferential direction through the conductive adhesive tape 7. Therefore, good electromagnetic-wave shielding efficiency can be obtained.

In the display panel of the third aspect, by utilizing a PDP which is integrated with the transparent base plate on which the conductive layer is formed, electromagnetic-wave shielding efficiency is imparted to the display panel itself, thereby lightening its weight, making its wall thinner, reducing the number of parts, and thus improving the productivity and reducing the cost. In addition, it can prevent the malfunction of a remote controller.

Since the transparent base plate on which the pattern-etched conductive film is formed is used to obtain the electromagnetic-wave shielding efficiency in the third aspect, it is able to obtain electromagnetic-wave shielding efficiency and light transparency as desired by selecting the etching pattern and to provide distinct pictures by preventing the moiré phenomenon.

And the display panel of the third aspect is manufactured easily by previously bonding the transparent base plate, on which the pattern-etched conductive film is formed, and the PDP body to integrate them.

Hereinafter, an embodiment of the fourth aspect of the present invention will be described in detail with reference to FIG. 5.

Figure 5:
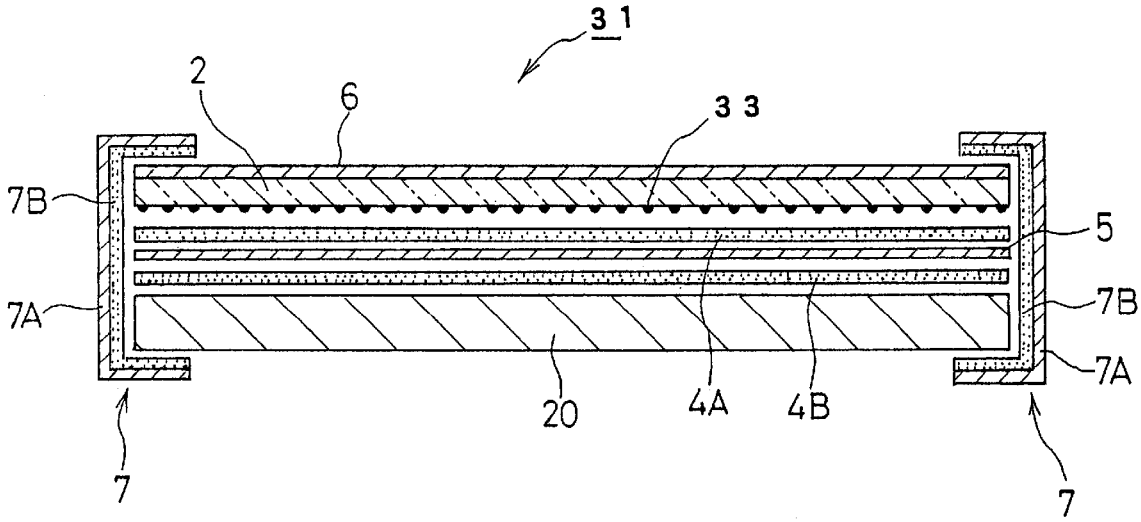
FIG. 5 is a schematic sectional view showing an embodiment of a display panel of the fourth aspect.

FIG. 5 is a schematic sectional view showing an embodiment of the display panel of the fourth aspect of the present invention This display panel 31 comprises a transparent base plate 2 on which a conductive layer 33 is formed by patterlfprinting (hereinafter, this conductive layer will be referred to as "conductive printed layer"), a PDP body 20 (any of typical PDPs such as the PDP having the structure as shown in FIG. 9), and a heat-ray blocking film 5 which is interposed between the transparent base plate 2 and the PDP body 20 by using intermediate adhesive layers 4A, 4B and integrated together.

In this embodiment, the conductive adhesive tape 7 adheres to all around ends of the assembled unit of the transparent base plate 2, the heat-ray blocking film 5, and the PDP body 20 and also adheres to outer edges of both surfaces of the assembled unit, i.e. outer edges of the front surface of the transparent base plate 2 and outer edges of the rear surface of the PDP body 20.

In the fourth aspect, the conductive adhesive tape 7, the transparent base plate 2, an anti-reflection coating 6 formed on the surface of the transparent base plate 2 may be the same described in the first aspect. The same is true for the soil resistant coating, the hard coating or anti-glare finish.

The conductive printed layer 33 can be formed on the plate surface of the transparent base plate 2 by screen process printing, ink jet printing or electrostatic printing, with conductive ink or conductive paste with the followings (1) or (2).

(1) Carbon black particles, or particles of metal such as copper, aluminum, or nickel or alloy thereof, of which particle size is 100 $\mu$m or less, with binder resin of PMMA, polyvinyl acetate, or epoxy resin, wherein the particles are dispersed in the binder resin such that the concentration of the particles are 50 to 90% by weight. Such ink is diluted with or dispersed in solvent toluene, xylene, methylene chloride, or water to a suitable concentration, then applied onto the plate surface by printing, and, if necessary, fixed on the plate surface by drying them at a temperature between a room temperature to 120° C.

(2) The same conductive particles as the above covered by binder resin. Such ink is directly applied onto the plate surface by the electrostatic printing and fixed by heating or the like.

It is not preferable that the conductive printed layer 33 thus formed is too thin because it reduces the electromagnetic-wave shielding efficiency and it is also not preferable that the conductive printed layer 33 is too thick because it affects the thickness of display panel to be obtained. Therefore, the thickness of the printed layer is preferably in a range from 0.5 to 100 $\mu$m.

The use of such pattern printing can provide a high degree of freedom for pattern so that the conductive printed layer 33 can be obtained in any line width, space, and opening configuration, thereby allowing easy formation of a conductive layer which never causes moiré phenomenon and has desired electromagnetic-wave shielding efficiency and light transparency.

In the fourth aspect, the configuration of printing pattern of the conductive printed layer 33 is not particularly limited. Examples include metallic films each formed in a lattice arrangement having rectangular.openings M and metallic films each formed in a punching metal-like arrangement having circular, hexagon, triangle, or elliptical openings M as shown in FIGS. 3A through 3F which are described above with respect to the etching patterns of the metallic foil of the second aspect. Besides the arrangements in which the openings M are regularly arranged, an arrangement in which openings M are randomly arranged may be used to prevent the moiré phenomenon.

In order to ensure the electromagnetic-wave shielding efficiency and the light transparency, the ratio of opening areas of the conductive printed layer relative to the projected area of the conductive printed layer (hereinafter, referred to as "open area ratio") is preferably in a range from 20 to 90%.

When the conductive printed layer is designed to have a greater open area ratio in order to improve the light transparency, a transparent conductive layer may be formed onto the transparent base plate 2, the front surface of the PDP body 20, or the heat-ray blocking film 5 to compensate a shortage of electromagnetic-wave shielding efficiency by the conductive printed layer 33.

The heat-ray blocking film 5 may be the same as described in the first aspect mentioned above and the adhesive resin for bonding the transparent base plate 2 on which the conductive printed layer 33 is formed by pattern printing, the heat-ray blocking film 5, and the PDP body 20 together may also be the same as the adhesive resin or preferably the transparent elastic adhesive resin described in the first aspect.

The intermediate adhesive layers 4A, 4B as adhesives, for example, formed in sheet configuration are used, and the heat-ray blocking film 5 is put between the intermediate adhesive layers 4A, 4B to make a pre-assembled unit. The pre-assembled unit is interposed between transparent base plate 2, on which the conductive printed layer 33 is previously formed by pattern printing, and the PDP body 20 and, after pre-compression bonding by deaerating them in vacuumed and warmed conditions, it is heated or radiated with light to harden the adhesive layers so as to form an assembled unit. In this manner, the display panel 31 shown in FIG. 5 can be manufactured easily.

The intermediate adhesive layers 4A, 4B are molded to have thickness from 1 $\mu$m to 1 mm preventing the thickness of the adhesive layer from being too thick.

After the transparent base plate 2, the heat-ray blocking film 5, and the PDP body 20 are integrated, the conductive adhesive tape 7 is wound around the periphery of the assembled unit and fixed and then they are bonded together by thermo compression bonding according to the hardening method of used conductive adhesive tape 7.

In order to ensure the conduction between the conductive adhesive tape 7 and the conductive printed layer 33, it is preferable to provide a conduction part by putting a conductive tape around the periphery of transparent base plate 2 on which the conductive printed layer 33 is formed and also bonding this conductive tape to the sides of the assembled unit with the conductive adhesive tape 7.

In this manner; the display panel 31 with the conductive adhesive tape 7 can be simply and easily built in the body of equipment just by inlaying in the body of equipment. In addition, good conduction between the pattern-printed conductive printed layer 33 and the body of equipment can be provided uniformly along the circumferential direction through the conductive adhesive tape 7. Therefore, good electromagnetic-wave shielding efficiency can be obtained.

In the display panel of the fourth aspect, by utilizing a PDP which is integrated with the conductive layer, electromagnetic-wave shielding efficiency is imparted to the display panel itself, thereby lightening its weight, making its wall thinner, reducing the number of parts, and thus improving the productivity and reducing the cost. In addition, it can prevent the malfunction of a remote controller.

Since the transparent base plate on which the conductive printed layer is formed by pattern printing is used to obtain the electromagnetic-wave shielding efficiency in the fourth aspect, it is able to obtain electromagnetic-wave shielding efficiency and light transparency as desired by selecting the printing pattern and to provide distinct pictures by preventing the moiré phenomenon.

And the display panel of the fourth aspect is manufactured easily by previously bonding the transparent base plate, on which the conductive printed layer is previously formed, and the PDP body to integrate them.

Hereinafter, an embodiment of the fifth aspect of the present invention will be described in detail with reference to FIG. 6.

Figure 6:
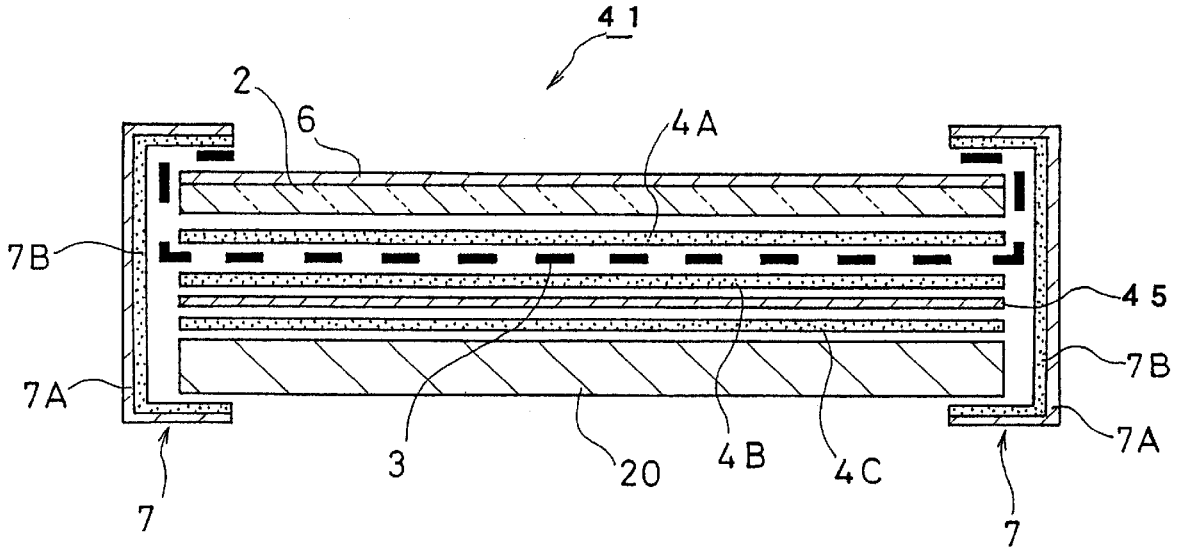
FIG. 6 is a schematic sectional view showing an embodiment of a display panel of the fifth aspect.

FIG. 6 is a schematic sectional view showing an embodiment of the display panel of the fifth aspect.

This display panel 41 comprises a transparent base plate 2, a PDP body 20 (any of typical PDPs such as the PDP having the structure as shown in FIG. 9), a conductive mesh member 3, and a transparent conductive film 45. The conductive mesh member 3 and the transparent conductive film 45 are interposed between the transparent base plate 2 and the PDP body 20 and are bonded together using intermediate adhesive layers 4A, 4B, 4C as adhesives so as to form an assembled unit. The periphery of the conductive mesh member 3 is positioned outside of peripheral edges of the transparent base plate 2 so as to form margins which are folded along the peripheral edges of transparent base plate 2 and bonded to the transparent base plate 2 by a conductive adhesive tape 7.

In this embodiment, the conductive adhesive tape 7 adheres to all around ends of the assembled unit of the transparent base plate 2, the conductive mesh member 3, the transparent conductive film 45, and the PDP body 20 and also adheres to outer edges of both surfaces of the assembled unit, i.e. outer edges of the front surface of the transparent base plate 2 and outer edges of the rear surface of the PDP body 20.

In the fifth aspect, the conductive mesh member 3, the conductive adhesive tape 7, the transparent base plate 2, an anti-reflection coating 6 formed on the surface of the transparent base plate 2 may be the same described in the first aspect. The same is true for the soil resistant coating, the hard coating or anti-glare finish.

The transparent conductive film 45 may comprise a resin film in which conductive particles are dispersed or a base film on which a transparent conductive layer is formed.

The conductive particles to be dispersed in the film may be any particles having conductivity and the following are examples of such conductive particles.

(i) carbon particles or powder;

(ii) particles or powder of metal such as nickel, indium, chromium, gold, vanadium, tin, cadmium, silver, platinum, aluminum, copper, titanium, cobalt, or lead, alloy thereof, or conductive oxide thereof; and (iii) particles made of plastic such as polystyrene and polyethylene, which are surfaced with coating layer of a conductive material of the above (i), (ii).

Because the conductive particles of large particle diameter affect the light transparency and the thickness of the transparent conductive film 45, it is preferable that the particle diameter is 0.5 mm or less. The preferable particle diameter of the conductive particles is between 0.01 and 0.5 mm.

The high mixing ratio of the conductive particles in the transparent conductive film 45 spoils the light transparency, while the low mixing ratio makes the electromagnetic-wave shielding efficiency short. The mixing ratio of the conductive particles is preferably between 0.1 and 50% by weight, particularly, between 0.1 and 20% by weight and, more particularly, between 0.5 and 20% by weight, relative to the resin of the transparent conductive film 45.

The color and the luster of the conductive particles can be suitably selected according to the application. In a case of a display filter, conductive particles having a dark color such as black or brown and dull surfaces are preferable. In this case, the conductive particles can suitably adjust the light transmittance of the filter so as to make the display easy-to-see.

The transparent conductive layer on the base film can be easily made of tin indium oxide, zinc aluminum oxide, or the like by one of methods including vapor deposition, sputtering, ion plating, and CVD. In this case, when the thickness of the transparent conductive layer is 0.01 $\mu$m or less, sufficient electromagnetic-wave shielding efficiency can not be obtained, because the thickness of the conductive layer for the electromagnetic-wave shielding is too thin, and when exceeding 5 $\mu$m, light transparency may be spoiled.

Examples of matrix resins of the transparent conductive film 45 or resins of a base film include polyester, polyethylene terephthalate (PET), polybutylene terephthalate, polymethyl methacrylate (PMMA), acrylic board, polycarbonate (PC), polystyrene, triacetate film, polyvinyl alcohol, polyvinyl chloride, polyvinylidene chloride, polyethylene, ethylenevinyl acetate copolymer, polyvinylbuthyral, metal ionic cross-linked ethylene-methacrylic copolymer, polyurethane, and cellophane. Preferably selected from the above are PET, PC, and PMMA.

The thickness of the transparent conductive film 45 is usually in a range of 1 μm–5 mm.

In the fifth aspect, the adhesive resin for bonding the transparent base plate 2, the conductive mesh member 3, the transparent conductive film 45, and the PDP body 20 may be the same as the adhesive resin or preferably the transparent elastic adhesive resin described in the first aspect.

The intermediate adhesive layers A, 4B, 4C, for example, formed in sheet configuration are used, and the conductive mesh member 3 and the transparent conductive film 45 are put between the intermediate adhesive layers 4A, 4B, 4C to make a pre-assembled unit. The pre-assembled unit is interposed between transparent base plate 2 and the PDP body 20 and, after pre-compression bonding by deaerating them in vacuumed and warmed conditions, it is heated or radiated with light to harden the adhesive layers so as to form an assembled unit. In this manner, the display panel 41 shown in FIG. 6 can be manufactured easily.

The intermediate adhesive layers 4A, 4B, 4C are molded to have thickness from 1 μm to 1 mm to prevent the thickness of the adhesive layer from being too thick. The conductive mesh member 3 which is made wider than transparent base plate 2 so that the periphery of the conductive mesh member 3 is positioned out of the peripheral edges of transparent base plate 2. The size of the transparent mesh member 3 is preferably set in such a manner that the width of the margins laid on the transparent base plate 2 is in a range from 3 to 20 mm.

After the transparent base plate 2, the conductive mesh member 3, the transparent conductive film 45, and the PDP body 20 are integrated, the margins of the conductive mesh member 3 are folded back and the conductive adhesive tape 7 is wound around the periphery of the assembled unit to fix the margins and then they are bonded together by thermo compression bonding according to the hardening method of used conductive adhesive tape 7.

Also f6r the transparent conductive film 45, to ensure the conduction between the film 45 and the conductive adhesive tape 7, a conductive tape is provided on the peripheral edges of the transparent conductive film 45 to extend outwardly from the assembled unit and this extending portion of the conductive tape is bonded to the sides of the assembled member by the conductive adhesive tape 7 so as to provide a conductive part.

In this manner, the display panel 41 with the conductive adhesive tape 7 can be simply and easily built in the body of equipment just by inlaying in the body of equipment. In addition, good conduction between the conductive mesh member 3, the transparent conductive film 45 and the body of equipment can be provided uniformly along the circumferential direction through the conductive adhesive tape 7. Therefore, good electromagnetic-wave shielding efficiency can be obtained.

The display panel shown in FIG. 6 is one of examples of the display panel of the fifth aspect and the fifth aspect is not limited thereto. For example, while the four side edges the conductive mesh member 3 are positioned out of the transparent base plate 2 and folded back in the illustrative embodiment, only two side edges opposite to each other may be positioned out of the transparent base plate 2 and folded back.

While the transparent conductive film is disposed between the conductive mesh member 3 and the PDP body 20 as shown in FIG. 6, a transparent conductive film may be disposed between the conductive mesh member 3 and the transparent base plate 2. Instead of the transparent conductive film, a transparent conductive film directly formed on the bonding surface of the transparent base plate 2 or on the front surface of the PDP body 20 may be used as the transparent conductive layer.

In the fifth aspect, a heat-ray blocking film may be provided between the transparent base plate 2 and the PDP body 20. In this case, the heat-ray blocking film may be the same as described with regard to the first aspect mentioned above.

In the display panel of the fifth aspect, by utilizing a PDP which is integrated with electromagnetic-wave shielding material, electromagnetic-wave shielding efficiency is imparted to the display panel itself, thereby lightening its weight, making its wall thinner, reducing the number of parts, and thus improving the productivity and reducing the cost. In addition, it can prevent the malfunction of a remote controller.

In the fifth aspect, the combination of the conductive mesh member and the transparent conductive layer, as electromagnetic-wave shielding materials, can provide electromagnetic-wave shielding efficiency and light transparency as desired and to provide distinct pictures by preventing the moiré phenomenon.

Hereinafter, an embodiment of the sixth aspect of the present invention will be described in detail with reference to FIGS. 8A, 8B.

Figure 8A:
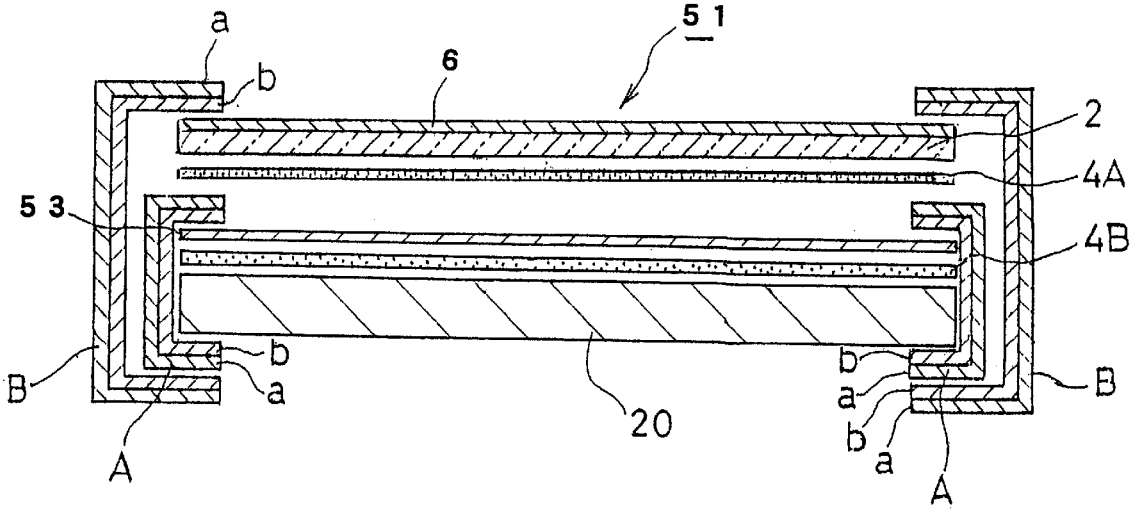
FIG. 8A is a schematic sectional view showing an embodiment of a display panel of the sixth aspect and FIG. 8B is a top plan view showing a transparent conductive film on which cross-linkable conductive adhesive tapes are attached.
Figure 8B:
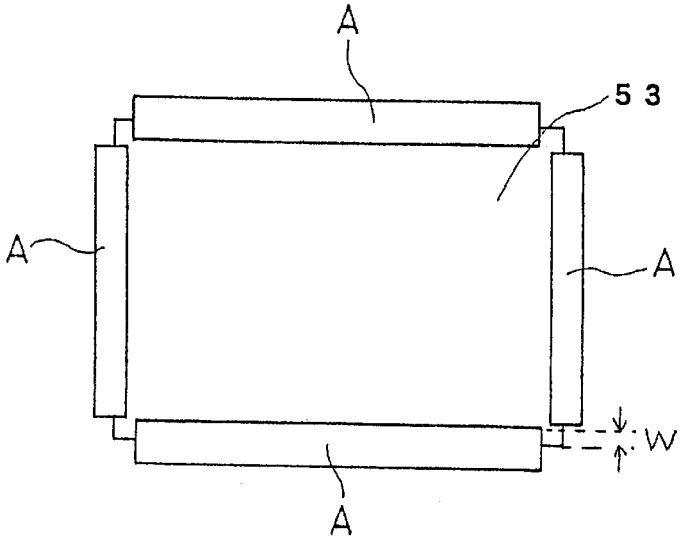

FIG. 8A is a schematic sectional view showing an embodiment of the display panel of the sixth aspect and FIG. 8B is a top plan view of a transparent conductive film to which a cross-linkable conductive adhesive tape is attached.

The display panel 51 comprises a transparent base plate 2, a PDP body 20 (any of typical PDPs such as the PDP having the structure as shown in FIG. 9), a transparent conductive film 53 which is interposed between the transparent base plate 2 and the PDP body 20 and are bonded together using intermediate adhesive layers A, 4B as adhesives so as to form an assembled unit. Cross-linkable conductive adhesive tapes A are bonded to a region from four side edges of the transparent conductive film 53 to peripheral edges at the rear surface of the PDP body 20, respectively.

In this embodiment, a cross-linkable conductive adhesive tape B is further bonded to all around ends of the assembled unit of the transparent base plate 2, the transparent conductive film 53 and the PDP body 20 in such a manner as to cover corners between surfaces and the end faces so that the cross-linkable conductive adhesive tape B is bonded to outer edges of the front surface of the transparent base plate 2 and outer edges of the rear surface of the PDP body 20.

Each of the cross-linkable conductive adhesive tapes A and B used in the present invention has a metallic foil s and an adhesive layer b in which conductive particles are dispersed wherein the adhesive layer b is disposed on one surface of the metallic foil a as shown in the drawing, and the adhesive layer b is a post-cross-linkable adhesive layer which contains polymer of which main component is ethylene-vinyl acetate copolymer and crosslinking agent.

Any of electrically good conductors may be used as the conductive particles to be dispersed in the adhesive layer b. For examples, metal powder of copper, silver, or nickel, resin or ceramic powder which is coated with the aforementioned metal may be employed as the conductor. There is no specific limitation on its configuration so that the particles may have any configuration such as palea-like, dendritic, granular, and pellet-like configurations.

The content of the conductive particles is preferably 0.1–15% by volume relative to the polymer (described later) composing the adhesive layer b and the average particle size is preferably 0.1–100 μm. The restriction on the content and the particle size prevents the condensation of the conductive particles so as to obtain good conductivity.

The polymer forming the adhesive layer b preferably contains, as the principal component thereof, ethylene-vinyl acetate copolymer selected from the following (I) through (III) and has melt index (MFR) from 1 to 3000, preferably from 1 to 1000, and more preferably from 1 to 800.

Use of the following copolymers (I) through (III), of which MFR is in a range from 1 to 3000 and of which vinyl acetate content is in a range from 2 to 80% by weight, improves tackiness before cross-linking to improve the working efficiency and rises the three-dimensional cross-linking density after cross-linking, thereby exhibiting quite high bond strength and also improving the moisture and heat resistance:

(I) ethylene-vinyl acetate copolymer in which vinyl acetate content is in a range from 20 to 80% by weight;

(II) copolymer of ethylene, vinyl acetate, acrylate and/or methacrylate monomer, in which vinyl acetate content is in a range from 20 to 80% by weight, and in which acrylate and/or methacrylate monomer content is in a range from 0.01 to 10% by weight; and (III) copolymer ethylene, vinyl acetate, maleic acid and/or maleic anhydride, in which vinyl acetate content is in a range from 20 to 80% by weight, and of which maleic acid and/or maleic anhydride content is in a range from 0.01 to 10% by weight.

In the ethylene-vinyl acetate copolymers of (I) through (III), the content of the vinyl acetate is in a range from 20 to 80% by weight, preferably from 20 to 60% by weight. Less than 20% by weight of vinyl acetate interferes with the exhibition of sufficient cross-linking in case of cross-linkage at high temperature, while more than 80% by weight decreases the softening temperature of resin in case of the ethylene-vinyl acetate copolymers of (I), (II), thereby making the storage difficult that is a problem in practical use, and tends to decrease the bond strength and the durability in case of the ethylene-vinyl acetate copolymer of (III).

In the copolymer of ethylene, vinyl acetate, acrylate and/or methacrylate monomer of (II), the content of the acrylate and/or methacrylate monomer is in a range from 0.01 to 10% by weight, preferably from 0.05 to 5% by weight. Less than 0–01% by weight of the monomer decreases the improvement of the bond strength, while more than 10% by weight tends to affect the workability. Examples of the acrylate and/or methacrylate monomer include monomers chosen fiom a group of acrylic ester and/or methacrylate ester monomers. Preferably employed as such a monomer is ester of acrylic acid or methaciylic acid and substituted aliphatic alcohol having non-substituting group or substituting group, such as epoxy group, including carbon atoms 1 through 20, particularly, 1 through 18. Examples include methyl acrylate, methyl methacrylate, ethyl acrylate, and glycidyl methacrylate.

In the copolymer ethylene, vinyl acetate, maleic acid and/or maleic anhydride of (III), the content of the maleic acid and/or maleic anhydride is in a range from 0.01 to 10% by weight, preferably from 0.05 to 5% by weight. Less than 0.01% by weight of the content decreases the improvement of the bond strength, while more than 10% by weight tends to affect the workability.

The polymer according to the present invention contains more than 40% by weight, particularly more than 60% by weight, of the ethylene-vinyl acetate copolymer of (I) through (III) and preferably consists of the ethylene-vinyl acetate copolymer of (I) through (III) without other component. When the polymer contains polymer besides the ethylene-vinyl acetate copolymer, the polymer besides the ethylene-vinyl acetate copolymer may be olefin polymer of which backbone contains more than 20 mole % of ethylene and/or propylene, polyvinyl chloride, acetal resin, or the like.

The crosslinking agent for the aforementioned polymer may be organic peroxide as crosslinking agent for heat curing to form a thermosetting adhesive layer or may be photosensitizer as crosslinking agent for photo-curing to form a photo-curing adhesive layer.

Such organic peroxide may be any organic peroxide that can be decomposed at a temperature above 70° C. to generate radical, preferably organic peroxide of which decomposition temperature during half-life period of 10 hours is higher than 50° C., and should be selected according to the temperature for applying adhesive material, the preparation condition, the storage stability, the temperature for curing (bonding), and the heat resistance of the adherend.

Examples of available peroxide includes 2,5-dimethylhexane-2,5-dihydro peroxide; 2,5-dimethyl-2,5-di (tert-butyl-peroxy)-hexane-3; di-tert-butyl peroxide; tert-butylcumyl peroxide; 2,5-dimethyl-2,5-di(tert-butyl-peroxy)-hexane; dicumyl peroxide; α, α'-bis(tert-butyl peroxy)-benzene; n-buthyl-4,4-bis(tert-butyl-peroxy)-valerate; 1,1-bis(tert-butyl-peroxy)-cyclohexane; 1,1-bis (tert-butyl-peroxy)-3,3,5-trimethylcyclohexane; tert-butyl peroxy benzoate; benzoyl peroxide; tert-butyl peroxy acetate; methyl ethyl ketone peroxide; 2,5-dimethylhexyl-2,5-bis-peroxy-benzoate; butyl hydroperoxide; p-menthane hydroperoxide; p-chlorbenzoyl peroxide; hydroxyheptyl peroxide; chlorhexanon peroxide; octanoyl peroxide; decanoyl peroxide; lauroyl peroxide; cumyl peroxy octoate; succinic acid peroxide; acetyl peroxide; tert-butyl-peroxy (2-ethylhexanoate); m-toluoyl peroxide; tert-butyl-peroxyisob-utyrate; and 2,4-dichlorobenzoyl peroxide. These are used alone or in mixed state, normally from 0.1 to 10% by weight relative to the aforementioned polymer.

On the other hand, suitably employed as such photosensitizer (photopolymerization initiator) is radical photopolymerization initiator. Available hydrogen-drawn type initiators among radical photopolymerization initiators include benzophenone; methyl o-benzoylbenzoate; 4-benzoyl-4'-methyl diphenyl sulfide; isopropylthioxanthone; diethylthioxanthone; and 4-(diethylamino) ethyl benzoate. Among radical photopolymerization initiators, intramolecular cleavage type initiators include benzoin ether, benzoin propyl ether, and benzyldimethl ketal, α-hydroxyalkyphenon type initiators include 2-hydroxy-2-methyl-1-phenylpropane-1-on, 1-hydroxycyclohexyl phenyl ketone, alkyl phenyl glyoxylate, and diethoxy acetophenone, α-amino-alkylphenone type initiators include 2-methyl-1-[4-(methylthio)phenyl]-2-morpholino propane-1, and 2-benzyl-2-dimethylamino-1-(4-morpholino phenyl) butanone-1, and acylphosphine oxide may be employed. These are used alone or in mixed state, normally from 0.1 to 10% by weight relative to the aforementioned polymer.

The adhesive layer according to the present invention preferably includes silane coupling agent as adhesive accelerator. Examples of the silane coupling agent include vinyltriethoxysilane, vinyl-tris (β-methoxyethoxy) silane, γ-methacryloxypropyl trimethoxy silane, vinyltriacetoxy silane, γ-glycidoxypropyltrimetoxysilane, γ-glycidoxypropyltrietoxysilane, β-(3,4-epoxycyclohexyl) ethyl trimethoxy silane, vinyltrichlorosilane, γ-mercaptopropyl trimethoxy silane, γ-aminopropyl triethoxy silane, and N-(β-aminoethyl)-γ-aminopropyl trimethoxy silane. These are used alone or in the mixed state, normally from 0.1 to 10% by weight relative to the aforementioned polymer.

The adhesive accelerator may contain epoxy group containing compound. Examples of epoxy group containing-.compound include triglycidyl tris(2-hydroxy ethyl) isocyanurate, neopentyl glycol diglycidyl ether, 1,6-hexane diol diglycidyl ether, alyl glycidyl ether, 2-ethyl hexyl glycidyl ether, phenyl glycidyl ether, phenol $(EO)_5$ glycidyl ether, p-tert-butyl phenyl glycidyl ether, diglycidylester adipate, diglycidylester phthalate, glycidyl methacrylate, and butyl glycidyl ether. The same effect can be obtained by alloying polymer containing epoxy group. These epoxy group containing compounds are used alone or in the mixed state, normally from 0.1 to 20% by weight relative to the aforementioned polymer.

In order to improve the properties (such as mechanical strength, adhesive property, optical property, heat resistance, moisture resistance, weatherability, and crosslinking speed) of the adhesive layer, a compound containing one selected from acryloxy group or methacryloxy group and one selected from allyl group may be added into the adhesive layer.

Such a compound used for this purpose is usually acrylic acid or methacrylic acid derivative, for example, ester or amide thereof. Examples of ester residues include alkyl group such as methyl, ethyl, dodecyl, stearyl, and lauryl and, besides such alkyl group, cycloxyhexyl group, tetrahydrofurfuryl group, aminoethyl group, 2-hydroethyl, 3-hydroxypropyl group, and 3-chloro-2-hydroxypropyl group. Ester with polyfunctional alcohol such as ethylene glycol, triethylene glycol polypropylene glycol, polyethylene glycol, trimethylolpropane, or pentaerythritol may be also employed. The typical one of such amide is diacetone acrylamide. Examples of polyfunctional crosslinking aid include acrylic ester or methacrylate ester such as trimethylolpropane, pentaerythritol, glycerin, and compounds having allyl group such as triallyl cyanurate, triallyl isocyanurate, diallyl phthalate, diallyl isophthalate, and diallyl maleate. These are used alone or in the mixed state, normally from 0.1 to 50% by weight, preferably from 0.5 to 30% by weight relative to the aforementioned polymer. More than 50% by weight of the content sometimes affects the working efficiency during preparation and the applying efficiency of the adhesive material.

In order to improve the workability and the ply adhesion of the adhesive layer, hydrocarbon resin may be added into the adhesive layer. Such hydrocarbon resin to be added for this purpose may be either natural resin or synthetic resin. Examples suitably employed as natural resin are rosin, rosin derivative, and terpene resin. Employed as rosin may be gum rosin, tall oil rosin, or wood rosin. Employed as rosin derivative is rosin which has been hydrogenated, disproportioned, polymerized, esterifyed, or metallic chlorinated. Employed as terpene resin may be terpene resin, such as α-pinene and β-pinene (nopinene), or terpene phenol resin. Besides the above natural resin, dammar, copal, or shellac may be employed. Examples suitably employed as synthetic resin are petroleum resin, phenolic resin, and xylene resin. Employed as petroleum resin may be aliphatic petroleum resin, aromatic petroleum resin, cycloaliphaticb petroleum resin, copolymer petroleum resin, hydrogenated petroleum resin, pure monomer petroleum resin, or coumarone-indene resin. Employed as phenolic resin may be alkylphenolic resin or modified phenolic resin. Employed as xylene resin may be xylene resin or modified xylene resin. The content of the hydrocarbon resin should be suitably selected, preferably from 1 to 200% weight, more preferably from 5 to 150% weight relative to the polymer.

The adhesive layer may further include antioxidant, ultraviolet absorbing agent, dye, and/or processing aid in such an amount not to affect the object of the present invention.

Examples of metal of the metallic foil a as the base of the cross-linkable conductive adhesive tape A, B of the present invention include copper, silver, nickel, aluminum, or stainless steel. The thickness of the metallic foil a is normally in a range from 1 to 100 μm.

The adhesive layer b is made of mixture in which the ethylene-vinyl acetate copolymer, cross-linking agent, other additives if necessary, and conductive particles are mixed uniformly in a predetermined ratio, and can be easily formed by applying the mixture onto the metallic foil a using a roll coater, a die coater a knife coater, a micabar coater, a flow coater, a spray coater or the like.

The thickness of the adhesive layer b is normally in a range from 5 to 100 μm.

In the sixth aspect, the transparent base plate 2, an anti-reflection coating 6 formed on the surface of the transparent base plate 2 may be the same as described in the first aspect. The same is true for the soil resistant coating, the hard coating or anti-glare finish.

The transparent conductive film 53 may be the same as described with regard to the fifth aspect mentioned above.

Examples of matrix resins of the transparent conductive film 53 or resins of a base film include polyester, polyethylene terepithalate (PEI), polybutylene terepbthalate, polymethyl methacrylate (PMMA), acrylic board, polycarbonate (PC), polystyrene, triacetate film, polyvinyl alcohol, polyvinyl chloride, polyvinylidene chloride, polyethylene, ethylenevinyl acetate copolymer, polyvinylbuthyral, metal ionic cross-linked ethylene-methacrylic copolymer, polyurethane, and cellophane. Preferably selected from the above are PET, PC, and PMMA.

The thickness of the transparent conductive film 53 is usually in a range form 1 μm to 5 mm.

In the sixth aspect, the adhesive resin for bonding the transparent base plate 2, the transparent conductive film 53, and the PDP body 20 may be the same as the adhesive resin or preferably the transparent elastic adhesive resin described in the first aspect.

For manufacturing the display panel 51 shown in FIGS. 8A, 8B, the transparent base plate 2 on which the anti-reflection coating 6 is applied, the PDP body 20, the transparent conductive film 53, the intermediate adhesive layer 4A, 4B, and the cross-linkable conductive adhesive tapes A, B are first prepared. The cross-linkable conductive adhesive tapes A are attached to the periphery of the transparent conductive film 53 and are bonded by thermo compression bonding using a heat sealer in such a manner as to be crosslinked to provide conduction between the film and the metallic foils. After that, the transparent conductive film 53 with the adhesive tapes A is put on the PDP body 20 through the intermediate adhesive layer 4B, and the transparent base plate 2 and the intermediate adhesive layer 4A are then put on them so as to make an assembled unit. They are heated or radiated with light with some pressures under the hardening condition of the intermediate adhesive layer so as to form an assembled unit. Moreover, the cross-linkable adhesive tape B is attached to cover a range from an outer edge of the front surface of the transparent base plate 2 to an outer edge of the back surface of the PDP body 20. In this manner, the display panel 51 is easily manufactured.

When using the cross-linkable conductive adhesive tapes A, B, each tape is bonded to the assembled unit by the tackiness of the adhesive layer b (this temporal adhesion allows re-adhesion if necessary) and is then heated or radiated with ultraviolet with some pressures as necessary. The ultraviolet radiation may be applied at the same time of heating. The cross-linkable conductive tape may be partially bonded by partially heating or radiating ultraviolet.

The thermo compression bonding can be easily conducted by a typical heat sealer. As one of compression and heating methods, a method may be employed that the integrated member bonded with the cross-linkable conductive adhesion tape is inserted into a vacuum bag which is then vacuumed and after that it is heated. Therefore, the bonding operation is quite easy.

The bonding condition in case of thermal cross-linking depends on the type of crosslinking agent (organic peroxide) to be employed. The cross-linking is conducted normally at a temperature from 70 to 150° C., preferably from 70 to 130° C. and normally for 10 seconds to 120 minutes, preferably 20 seconds to 60 minutes.

In case of optical cross-linking, many light sources emitting in an ultraviolet to visible range may be employed. Examples include an extra-high pressure, high pressure, or low pressure mercury lamp, a chemical lamp, a xenon lamp, a halogen lamp, a Mercury halogen lamp, a carbon arc lamp, an incandescent lamp, and a laser radiation. The period of radiation is not limited because it depends on the type of lamp and the strength of the light source, but normally in a range from dozens of seconds to dozens of minutes. In order to aid the crosslinking, ultraviolet may be radiated after previously heating to 40–120° C.

The pressure for bonding should be suitably selected and is preferably 0–50 kg/cm$^2$, particularly 0–30 kg/cm$^2$.

The width (W of FIG. 8B) of a bonding portion of cross-linkable conductive adhesive tape A at the edge of transparent conductive film 53 depends on the area of the electromagnetic-wave shielding and light transparency plate to be obtained, and usually in a range of 3–20 mm.

In this manner, the display panel 51 with the cross-linkable conductive adhesive tapes A, B can be simply and easily built in the body of equipment just by inlaying in the body of equipment. In addition, good conduction between the transparent conductive film 53 and the body of equipment can be provided uniformly at the four edges thereof through the cross-linkable conductive adhesive tapes A, B. Therefore, good electromagnetic-wave shielding efficiency can be obtained.

The display panel shown in FIGS. 8A, 8B is just one of. examples of the display panel of the sixth aspect and it is to be understood that the sixth aspect is not limited thereto. For example, the cross-linkable conductive tapes A, B are attached to the four side edges of the transparent conductive film 53 in the illustrative embodiment, but may be attached to only two side edges opposite to each other. It should be understood that the bonding on four-side edges is better in terms of uniform current conduction.

In the display panel of the sixth aspect, metallic foil, which is formed in lattice or punching metal-like arrangement by pattern etching and is interposed between the transparent base plate and the PDP body, may be used in place of the transparent conductive film of the display panel shown in FIGS. 8A, 8B. Also in this case, the metallic foil is easy to tear at the folded portion. Without folding the metallic foil, current conduction can be easily provided.

In the display panel of the sixth aspect, a heat-ray blocking film as mentioned above can be provided between the transparent base plate 2 and the PDP body 20.

In the display panel of the sixth aspect, by utilizing a PDP which is integrated with the transparent conductive film, electromagnetic-wave shielding efficiency is impaited to the display panel itself, thereby lightening its weight, making its wall thinner, reducing the number of parts, and thus improving the productivity and reducing the cost. In addition, it can prevent the malfunction of a remote controller.

Furthermore, the display of the sixth aspect can be easily assembled and easily built in a body of equipment as an object of installation and can provide uniform and low-resistant conduction relative to the body of equipment, thereby exhibiting high electromagnetic-wave shielding efficiency.

What is claimed is:

1. A display panel comprising a plasma display panel body, an electromagnetic-wave shielding material bonded to a front surface of the plasma display panel body, transparent adhesives for bonding the electromagnetic-wave shielding material to the plasma display panel body, and conductive adhesive tapes provided at side ends of the plasma display panel body and the electromagnetic-wave shielding material to partly cover a front portion of the electromagnetic-wave shielding material and a back portion of the plasma display panel.

2. A display panel as claimed in claim 1, wherein the electromagnetic-wave shielding material is a conductive mesh member.

3. A display panel as claimed in claim 1, further comprising a transparent base plate which is bonded to a front surface of the electromagnetic-wave shielding material by transparent adhesives.

4. A display panel as claimed in any claim 1, wherein the transparent adhesives are transparent elastic adhesives.

5. A display panel as claimed in claim 1, wherein said conductive adhesive tapes are provided entirely around the side ends of the display panel.

6. A display panel comprising a plasma display panel body, a conductive mesh member as an electromagnetic-wave shielding material bonded to a front surface of the plasma display panel body, a transparent base plate bonded to a front surface of the, conductive mesh member, transparent elastic adhesives for bonding the conductive mesh member to the plasma display panel body and bonding the transparent base plate to the conductive mesh member, and conductive adhesive tapes provided at side ends of the plasma display panel body, the conductive mesh member and the transparent base plate to partly cover a front portion of the transparent base plate and a back portion of the plasma display panel.

7. A display panel as claimed in claim 6, wherein the conductive mesh member is made of at least one kind of fibers selected from a group consisting of metallic fibers and metal-coated organic fibers having a line width between 1 $\mu$m and 1 mm and open area ratio between 50 and 90%.

8. A display panel comprising a plasma display panel body, a conductive composite mesh member bonded to a front surface of the plasma display panel body, said composite mesh member including organic fibers and at least one kind of fibers selected from a group consisting of metallic fibers and metal-coated organic fibers, which are woven together, a transparent base plate bonded to a front surface of the conductive composite mesh member, transparent elastic adhesives for bonding the mesh member to the plasma display panel body and bonding the transparent base plate to the composite mesh member, and conductive adhesive tapes provided at side ends of the plasma display panel body, the composite mesh member and the transparent base plate to partly cover a front portion of the transparent base plate and a back portion of the plasma display panel.

9. A display panel as claimed in claim 8, wherein the line width of the conductive composite mesh member is 1–200 $\mu$m and an open area ration is 30–99.9%.

10. A display panel as claimed in claim 8, wherein a ratio of said at least one kind of the fibers selected from the group consisting of the metallic fibers and metal-coated organic fibers, and the organic fibers of the conductive composite mesh member is 1:1–1:10 by a number of the fibers.

11. A display panel comprising a plasma display panel body, an electromagnetic-wave shielding material bonded to a front surface of the plasma display panel body, a transparent base plate bonded to a front surface of the electromagnetic-wave shielding material, a heat-ray blocking layer interposed between the transparent base plate and the plasma display panel body, transparent adhesives for bonding the transparent base plate, the electromagnetic-wave shielding material, the heat-ray blocking layer and the plasma display panel body, and conductive adhesive tapes provided at side ends of the plasma display panel body, the heat-ray blocking layer, the electromagnetic-wave shielding material and the transparent base plate to partly cover a front portion of the transparent base plate and a back portion of the plasma display panel.

12. A display panel comprising a plasma display panel body, an electromagnetic-wave shielding material formed of a conductive foil made by pattern etching and bonded to a front surface of the plasma display panel body, a transparent base plate bonded to a front surface of the electromagnetic-wave shielding material, transparent elastic adhesives for bonding the electromagnetic-wave shielding material to the plasma display panel body and bonding the transparent base plate to the electromagnetic-wave shielding material, and conductive adhesive tapes provided at side ends of the plasma display panel body, the electromagnetic-wave shielding material and the transparent base plate to partly cover a front portion of the transparent base plate and a back portion of the plasma display panel.

13. A display panel as claimed in claim 12, wherein the ratio of opening areas of the conductive foil relative to a projected area of the conductive foil is in a range from 20 to 90%.

14. A display panel as claimed in claim 12, further comprising a heat-ray blocking layer disposed between the transparent base plate and the plasma display panel body.

15. A display panel comprising a plasma display panel body, a transparent base plate bonded to a front surface of the plasma display panel body and having a conductive layer on a bonding surface thereof composed of a conductive film formed by pattern etching, transparent adhesives for bonding the transparent base plate to the plasma display panel body, and conductive adhesive tapes provided at side ends of the plasma display panel body and the transparent base plate to partly cover a front portion of the transparent base plate and a back portion of the plasma display panel.

16. A display panel as claimed in claim 15, wherein the ratio of opening areas of the conductive film relative to a projected area of the conductive film is in a range from 20 to 90%.

17. A display panel comprising a plasma display panel body, a transparent base plate bonded to a front surface of the plasma display panel body and having a conductive layer on a bonding surface thereof made of conductive ink by pattern etching, transparent adhesives for bonding the transparent base plate to the plasma display panel body, and conductive adhesive tapes provided at side ends of the plasma display panel body and the transparent base plate to partly cover a front portion of the transparent base plate and a back portion of the plasma display panel.

18. A display panel as claimed in claim 17, wherein a ratio of opening areas of the conductive layer relative to a projected area of the conductive layer is in a range from 20 to 90%.

19. A display panel comprising a plasma display panel body, a conductive mesh member bonded to a front surface of the plasma display panel body, a transparent base plate bonded to a front surface of the conductive mesh member, a transparent conductive layer disposed between the plasma display panel body and the transparent base plate, transparent adhesives for bonding the conductive mesh member, the plasma display panel body, the transparent base plate and the transparent conductive layer, and conductive adhesive tapes provided at side ends of the plasma display panel body, the conductive mesh member, the transparent base plate and the transparent conductive layer to partly cover a front portion of the transparent base plate and a back portion of the plasma display panel.

20. A display panel as claimed in claim 19, wherein the transparent conductive layer is a transparent conductive film.

21. A display panel as claimed in claim 20, wherein the transparent conductive film comprises a resin film in which conductive particles are dispersed or a base film on which a transparent conductive layer is formed.

22. A display panel as claimed in claim 20, wherein the transparent conductive film is a resin film in which conductive particles are dispersed and its blending ratio is 0.1–50% by weight relative to resin.

23. A display panel comprising a plasma display panel body, a transparent conductive film bonded to a front surface of the plasma display panel body, a transparent base plate bonded to a front surface of the transparent conductive film, first conductive adhesive tapes bonded to cover portions from outer edges of the transparent conductive film to outer edges of a rear surface of the plasma display panel body through side ends of the plasma display panel body and the transparent conductive film, transparent adhesives for bonding the transparent conductive film, the plasma display panel body and the transparent base plate, and second conductive adhesive tapes provided at side ends of the plasma display panel body, the transparent conductive film, the transparent base plate and the first conductive adhesive tapes to partly cover a front portion of the transparent base plate and a back portion of the plasma display panel.

24. A display panel as claimed in claim 23, wherein each of the conductive adhesive tapes is a cross-linkable conductive tape.

25. A display panel as claimed in claim 24, wherein the cross-linkable conductive adhesive tape comprises a metallic foil and an adhesive layer, in which conductive particles are dispersed, on one surface of the metallic foil, and the adhesive layer is a post-cross-linkable adhesive layer which contains polymer, main component being ethylene-vinyl acetate copolymer, and a crosslinking agent.

26. A display panel as claimed in claim 25, wherein the polymer contains, as its main component, ethylene-vinyl acetate copolymer selected from following (I)–(III), and its melt index (MFR) is 1–3000, (I) ethylene-vinyl acetate copolymer in which vinyl acetate content is in a range from 20 to 80% by weight;

(II) copolymer of ethylene, vinyl acetate, acrylate and/or methacrylate monomer, in which vinyl acetate content is in a range from 20 to 80% by weight, and acrylate and/or methacrylate monomer content is in a range from 0.01 to 10% by weight; and (III) copolymer ethylene, vinyl acetate, maleic acid and/or maleic anhydride, in which vinyl acetate content is in a range from 20 to 80% by weight, and maleic acid and/or maleic anhydride content is in a range from 0.01 to 10% by weight.

* * * * *